US010188158B2

(12) United States Patent
Molyneux et al.

(10) Patent No.: US 10,188,158 B2
(45) Date of Patent: Jan. 29, 2019

(54) WETSUITS WITH HYDRODYNAMIC INTERLOCKING AND KINESIOLOGIC FEATURES

(71) Applicant: NIKE, Inc., Beaverton, OR (US)

(72) Inventors: James Molyneux, Portland, OR (US); Ty A. Ransom, Portland, OR (US)

(73) Assignee: Nike, Inc., Beaverton, OR (US)

( * ) Notice: Subject to any disclaimer, the term of this patent is extended or adjusted under 35 U.S.C. 154(b) by 679 days.

(21) Appl. No.: 14/709,892

(22) Filed: May 12, 2015

(65) Prior Publication Data

US 2015/0237928 A1 Aug. 27, 2015

Related U.S. Application Data

(63) Continuation of application No. 13/408,344, filed on Feb. 29, 2012, now Pat. No. 9,056,662.

(51) Int. Cl.

| | |
|---|---|
| ***A41D 13/012*** | (2006.01) |
| ***B63C 11/04*** | (2006.01) |
| *A41D 13/00* | (2006.01) |
| *A63B 31/08* | (2006.01) |

(52) U.S. Cl.

CPC ..... *A41D 13/012* (2013.01); *B63C 11/04* (2013.01); *A41D 13/0015* (2013.01); *A41D 2400/24* (2013.01); *A63B 31/08* (2013.01); *B63C 2011/046* (2013.01)

(58) Field of Classification Search

CPC ..... A41D 13/0015; A41D 13/012; A41D 2400/24; A63B 31/08; B63C 11/04; B63C 2011/046

See application file for complete search history.

(56) References Cited

U.S. PATENT DOCUMENTS

| | | | | |
|---|---|---|---|---|
| 4,397,636 | A | 8/1983 | Ganshaw et al. | |
| 5,013,271 | A | 5/1991 | Bartlett et al. | |
| 5,052,053 | A * | 10/1991 | Peart | A41D 13/012 2/2.16 |
| D380,286 | S | 7/1997 | O'Neill | |
| D381,489 | S | 7/1997 | O'Neill | |
| 5,742,936 | A | 4/1998 | Tronc et al. | |
| 5,768,703 | A | 6/1998 | Machado et al. | |
| 6,260,199 | B1 | 7/2001 | Grunstein et al. | |
| 6,434,749 | B1 | 8/2002 | Grounds et al. | |

(Continued)

FOREIGN PATENT DOCUMENTS

| | | |
|---|---|---|
| EP | 0701782 A1 | 3/1996 |
| GB | 2444804 A | 6/2008 |

(Continued)

OTHER PUBLICATIONS

European Office Action dated Jul. 13, 2016 for European Patent Application No. 13717353.0, 6 pages.

(Continued)

*Primary Examiner* — Anna Kinsaul

(74) *Attorney, Agent, or Firm* — Shook, Hardy & Bacon L.L.P.

(57) ABSTRACT

A wetsuit for aquatic activities may include a wetsuit material having a first surface and an opposite second surface. The wetsuit comprises one or more sipes on the first surface that extend from an upper portion of a chest region of the wetsuit to a lateral portion of the chest region of the wetsuit.

19 Claims, 15 Drawing Sheets

(56) References Cited

U.S. PATENT DOCUMENTS

| | | | |
|---|---|---|---|
| 7,051,375 | B2 | 5/2006 | Polak et al. |
| 7,252,625 | B1 | 8/2007 | Perka |
| 7,404,213 | B2 | 7/2008 | Lieberman |
| 7,631,363 | B2 | 12/2009 | Myerscough |
| 7,937,852 | B1 | 5/2011 | Krehbiel |
| 7,941,871 | B1 | 5/2011 | Jorgensen |
| 7,992,218 | B2 | 8/2011 | O'Hara |
| 8,578,512 | B2 | 11/2013 | Moore et al. |
| 2002/0040495 | A1 | 4/2002 | Long |
| 2005/0114978 | A1 | 6/2005 | Benini |
| 2006/0073943 | A1 | 4/2006 | Perka |
| 2007/0294797 | A1 | 12/2007 | Furgerson et al. |
| 2010/0269238 | A1 | 10/2010 | O'Hara |
| 2011/0088280 | A1 | 4/2011 | Myerscough |
| 2011/0151733 | A1 | 6/2011 | Gadler |
| 2011/0265234 | A1 | 11/2011 | Tsang et al. |
| 2011/0275969 | A1 | 11/2011 | Quinn |
| 2012/0023631 | A1 | 2/2012 | Fischer |

FOREIGN PATENT DOCUMENTS

| | | | |
|---|---|---|---|
| WO | 9110476 | A1 | 7/1991 |
| WO | 03103423 | A1 | 12/2003 |
| WO | 2013130554 | A1 | 9/2013 |

OTHER PUBLICATIONS

International Search Report with Written Opinion dated Jul. 15, 2013 in PCT Application No. PCT/US2013/027953, 20 pages.

International Preliminary Report on Patentability dated Sep. 12, 2014 in PCT Application No. PCT/US2013/027953, 14 pages.

Non-Final Office Action dated Jun. 3, 2014 in U.S. Appl. No. 13/408,344, 21 pages.

Notice of Allowance dated Feb. 9, 2015 in U.S. Appl. No. 13/408,344, 10 pages.

European Office Action dated Mar. 30, 2017 for European Patent Application No. 13717353.0, 7 pages.

* cited by examiner

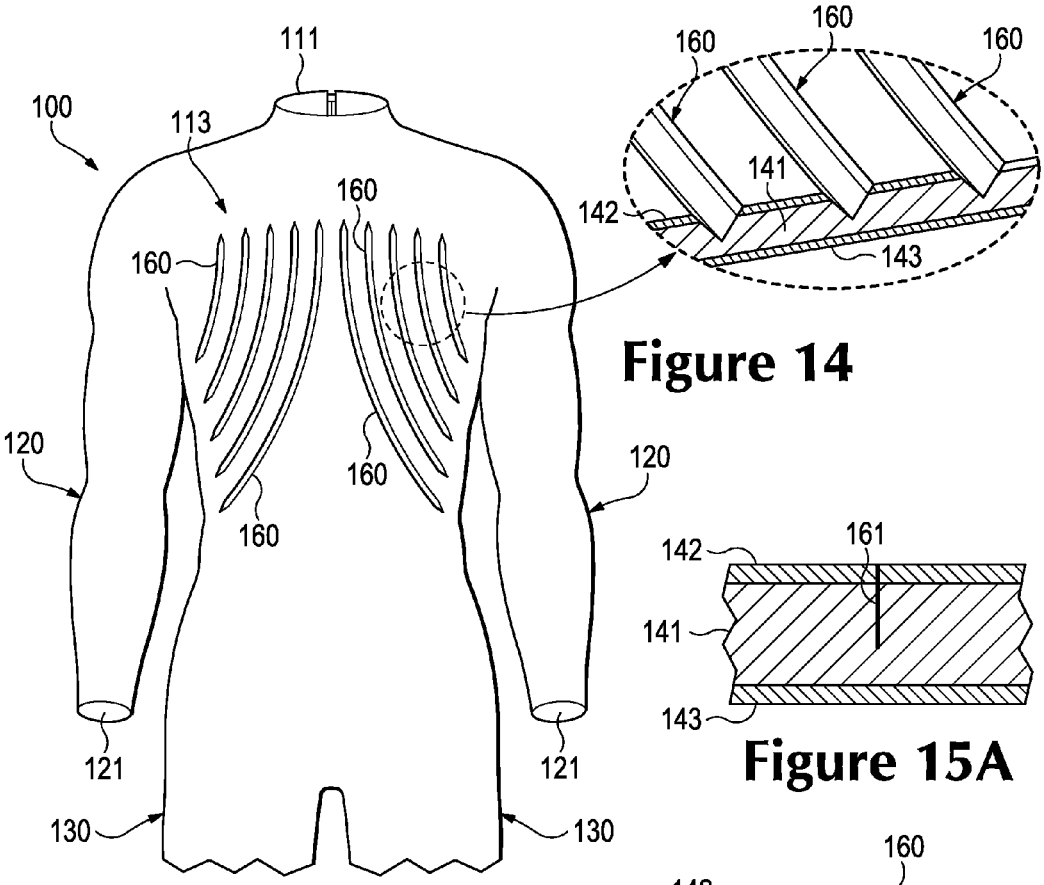
Figure 14
Figure 15A
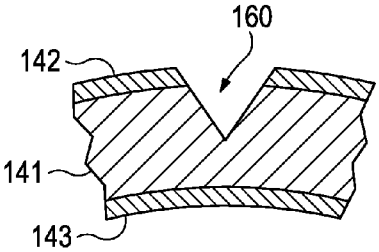
Figure 15B
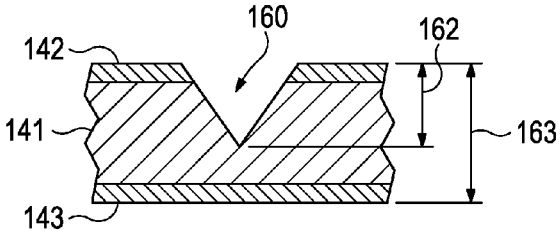
Figure 16A
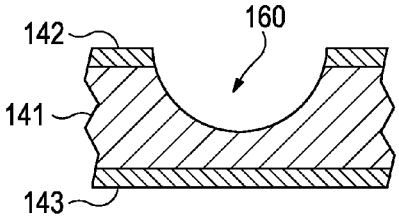
Figure 16B
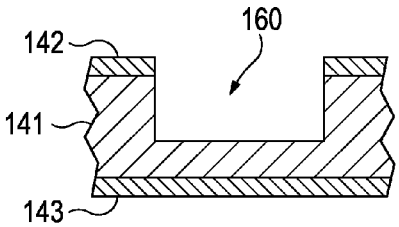
Figure 16C

WETSUITS WITH HYDRODYNAMIC INTERLOCKING AND KINESIOLOGIC FEATURES

CROSS-REFERENCE TO RELATED APPLICATIONS

This application having U.S. application Ser. No. 14/709,892, filed May 12, 2015, and entitled "Wetsuits with Hydrodynamic Interlocking and Kinesiologic Features" is a Continuation application of pending U.S. application Ser. No. 13/408,344, entitled "Wetsuits with Hydrodynamic Interlocking and Kinesiologic Features," and filed Feb. 29, 2012, now issued as U.S. Pat. No. 9,056,662 on Jun. 16, 2015. The entirety of the aforementioned application is incorporated by reference herein.

BACKGROUND

Wetsuits are commonly worn to provide thermal insulation, buoyancy, and abrasion resistance while engaging in various aquatic activities, such as surfing, scuba diving, snorkeling, open water swimming, kayaking, and windsurfing. Although wetsuits may also be formed from various materials, a majority of wetsuits incorporate neoprene, also known as polychloroprene, which is a synthetic rubber produced by the polymerization of chloroprene. Neoprene for wetsuits is generally foamed, often with nitrogen gas, to form gas-filled cells within the material, which enhance thermal insulation and buoyancy properties. Typically, backing layers (e.g., nylon textile elements) are secured to opposite surfaces of a neoprene element to impart strength and abrasion-resistance.

Features of wetsuits may vary depending upon the specific aquatic activity or water temperature for which the wetsuits are designed. As an example, a wetsuit for activities that require significant movement (e.g., surfing and windsurfing) may have backing materials with elastane (i.e., spandex) to reduce limitations on movement while wearing the wetsuit. A wetsuit for scuba diving and/or for use in colder waters may include water-resistant seals (e.g., rubber cuffs) at wrist, ankle, and neck openings to limit the entry of water. Additionally, a wetsuit for open water swimming may only include a single layer of backing material located on an inner surface (i.e., facing and contacting the wearer) to reduce drag, although additional texture may be included in arm areas to enhance pull during swimming. Moreover, some wetsuits primarily cover only the torso of a wearer to impart a greater freedom of movement in the arms and legs, while other wetsuits may cover the torso, arms, and legs to impart greater thermal insulation. Wetsuits designed for warmer waters may incorporate relatively thin neoprene elements (e.g., 0.5-2 millimeters), whereas wetsuits designed for colder waters may incorporate relatively thick neoprene elements (e.g., 2-6 millimeters or more). Accordingly, multiple features of wetsuits may vary considerably.

SUMMARY

A wetsuit for aquatic activities is disclosed below. In one aspect, the present disclosure is directed to a wetsuit including a wetsuit material having a first surface and an opposite second surface. The wetsuit may also include a chest pad located on the first surface in an anterior portion of the wetsuit corresponding with a portion of the wetsuit associated with the chest region of a wearer of the wetsuit. The chest pad may include a left-angled superior surface and a right-angled superior surface that intersect at a prow disposed at a superior portion of the chest pad, each of the left-angled superior surface and the right-angled superior surface being configured to route water from the chest region in a lateral direction.

The features of the wetsuit may vary considerably. In another aspect, the present disclosure is directed to a wetsuit including a wetsuit material having a first surface and an opposite second surface. The wetsuit may also include at least one sipe in the first surface, extending from an upper portion of a chest region of the wetsuit to a lateral portion of the chest region of the wetsuit.

In another aspect, the present disclosure is directed to a wetsuit including a wetsuit material having a first surface and an opposite second surface; and a first paddling assist member disposed on an arm region of the wetsuit. The first paddling assist member may include a flap portion on the first surface configured to lay flat while inserting the arm region into water, and extend outward from the first surface when the arm region is drawn backward during a paddling stroke movement to provide greater resistance to the movement and, thereby, increase the thrust provided by the movement.

In another aspect, the present disclosure is directed to a wetsuit including a wetsuit material formed in a first section and a second section. The first section and the second section may be configured to be adjoined together to enclose a portion of the body of a wearer. The first section may include a first adjoining edge portion having a first edge thickness that is less than a thickness of adjacent portions of the first section. In addition, the second section may include a second adjoining edge portion having a second edge thickness that is less than a thickness of adjacent portions of the second section. Further, the first adjoining edge portion and the second adjoining edge portion may be configured to fit together in an overlapping configuration such that the combined thickness of corresponding portions of the edge portions is approximately the same as the thickness of adjacent portions of the first section and the second section.

In another aspect, the present disclosure is directed to a wetsuit including a wetsuit material. The wetsuit may further include an elongate kinesiology strip formed of an elastic material and incorporated into the wetsuit material in a location and orientation configured to exert tension on the wetsuit in a predetermined direction.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

FIG. 14 illustrates anterior and cross-sectional views of a wetsuit having a plurality of sipes in a chest region of the wetsuit.

FIGS. 15A and 15B are cross-sectional views a slit, which forms a sipe in a wetsuit when the wetsuit material is conformed to a convex surface of a surfer's body.

FIGS. 16A-16C are cross-sectional views of sipes having alternative configurations.

DETAILED DESCRIPTION

The following discussion and accompanying figures disclose various configurations of a wetsuit. Such configurations may include features that provide hydrodynamic advantages, comfort, paddle assistance, support, and/or improved fitment.

The terms of anatomical location used in this disclosure, including the terms "anterior," "posterior," "inferior," "superior," "medial," and "lateral" shall have their traditional medical/anatomical meanings. That is, when considering a human standing in the upright position, the anterior direction is the forward facing direction, the posterior direction is the rearward facing direction, the inferior direction is the downward facing direction, the superior direction is the upward facing direction, the medial direction is the direction from the sides toward the centerline of the body, and the lateral direction is the direction from the centerline of the body toward the sides.

General Wetsuit Configuration

Figure 1:
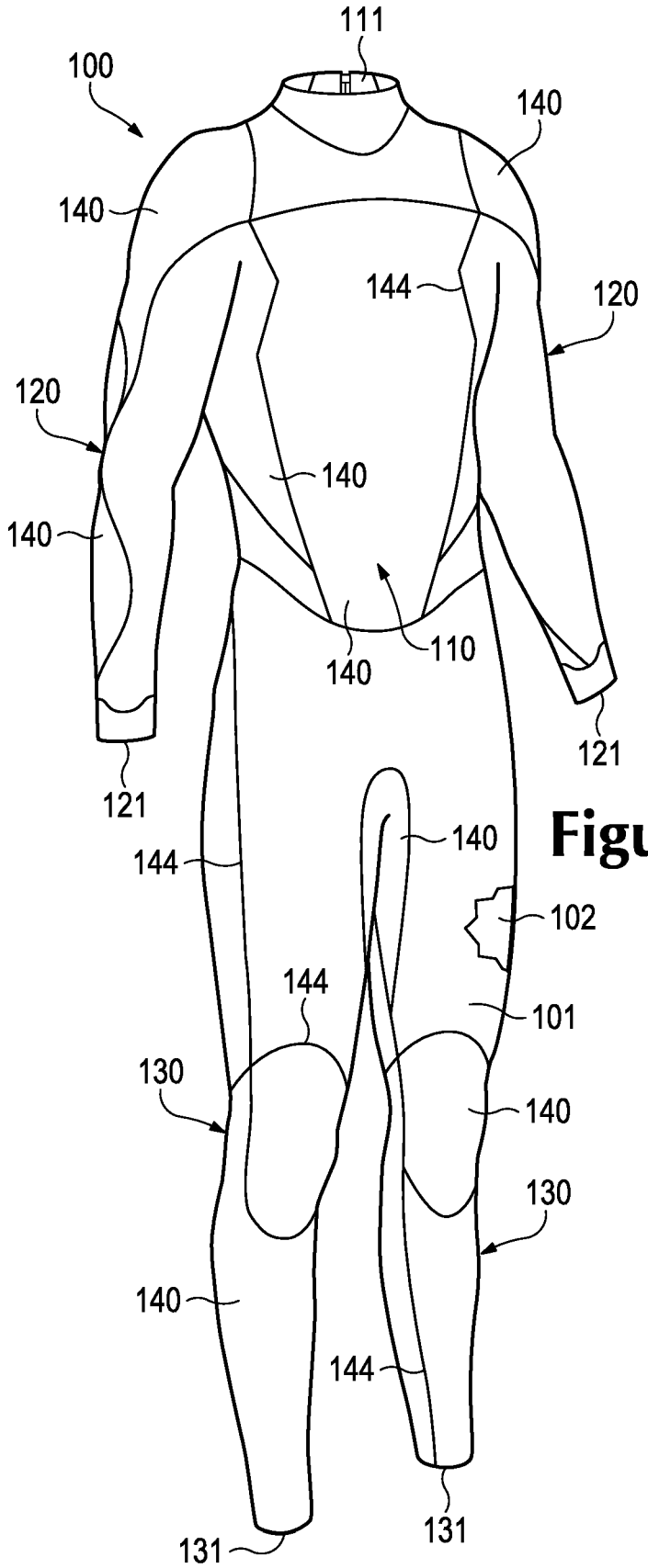
FIG. 1 is an anterior, perspective view of a wetsuit for aquatic activities.
Figure 2:
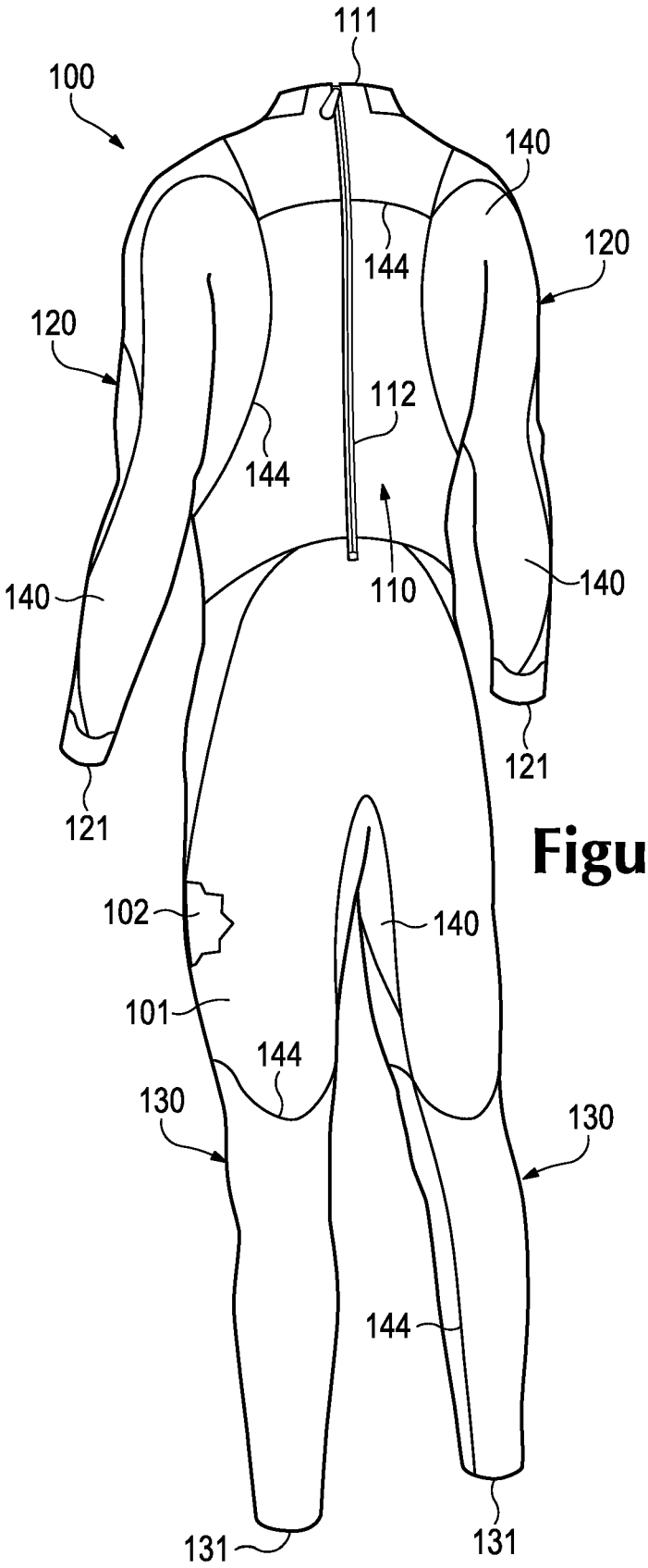
FIG. 2 is a posterior, perspective view of the wetsuit shown in FIG. 1.

As depicted in FIGS. 1 and 2, a wetsuit 100 may include a torso region 110, a pair of arm regions 120, and a pair of leg regions 130. Torso region 110 covers a torso of an individual when wetsuit 100 is worn. More particularly, torso region 110 extends from a neck and shoulders of the individual to a pelvic area of the individual, thereby covering the chest, back, and sides of the individual. An upper area of torso region 110 defines a neck opening 111 that extends around a neck of the individual. A zippered opening 112 also extends downward through a portion of a back area of torso region 110 to facilitate entry and removal of wetsuit 100, although other types and locations of openings may be utilized. Arm regions 120 cover at least a portion of a right arm and a left arm of the individual when wetsuit 100 is worn. End areas of arm regions 120 each define a wrist opening 121 that extends around a wrist of the individual. Leg regions 130 cover at least a portion of a right leg and a left leg of the individual when wetsuit 100 is worn. Lower areas of leg regions 130 each define an ankle opening 131 that extends around an ankle of the individual. Wetsuit 100 also includes an exterior surface 101 that faces away from the individual and an opposite interior surface 102 that faces toward the individual and may contact the individual.

The general configuration of wetsuit 100 depicted in FIGS. 1 and 2 covers substantially all of the torso, arms, and legs of the individual. As such, wetsuit 100 may be referred to as a "full suit" or "steamer." The concepts disclosed herein may also be applicable to other types of wetsuits, such as (a) a "shorty" or "spring suit" that covers the torso and has short arm regions and leg regions, (b) a "long john" or "johnny suit" that covers the torso and legs only, (c) a "jacket" that covers the torso and arms, with little or no coverage of the legs, and (d) a "vest" that covers the torso and may include a hood for covering a portion of the head. Accordingly, various types of wetsuits may incorporate the features shown and described in by the present disclosure.

Wetsuit 100 is generally formed from a plurality of material elements 140 that are joined at various seams 150. Although a variety of methods may be utilized to join material elements 140 at seams 150, one or more of adhesive bonding, thermal bonding, taping, and stitching (e.g., blind stitching) may be utilized. In addition to material elements 140, wetsuit 100 may include various additional elements not depicted in the figures. As an example, wetsuit 100 may include seals (e.g., rubber rings) around openings 111, 121, and 131 to limit the flow of water into wetsuit 100 and between interior surface 102 and the individual. A zipper and seal may also be included at zippered opening 112. Abrasion-resistant elements may also be located at knee and elbow areas, for example. Additionally, indicia identifying the manufacturer, placards providing instructions on the care of wetsuit 100, and various aesthetic features may be located on either of surfaces 101 and 102.

Figure 3:
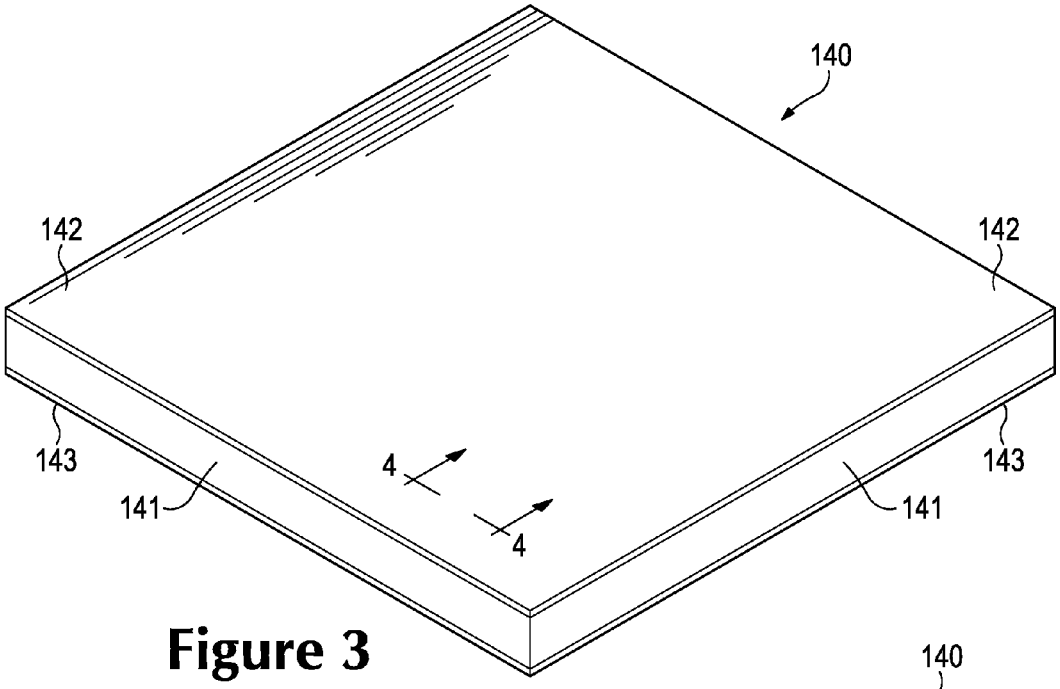
FIG. 3 is a perspective view of a portion of wetsuit material.
Figure 4:
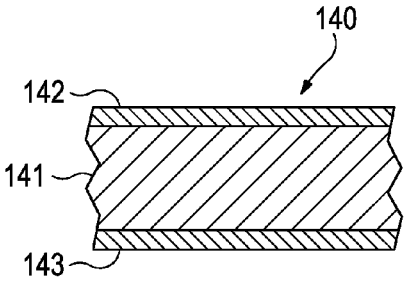
FIG. 4 is a cross-sectional view of the wetsuit material depicted in FIG. 3.

A portion of one of material elements 140 is depicted in FIGS. 3 and 4 as including a base layer 141, an exterior backing layer 142, and an interior backing layer 143. Base layer 141 is located between and joined with exterior backing layer 142 and interior backing layer 143. That is, backing layers 142 and 143 are secured to opposite surfaces of base layer 141. Whereas exterior backing layer 142 may form a portion of exterior surface 101, interior backing layer 143 may form a portion of interior surface 102.

A variety of materials may be utilized for base layer 141 and backing layers 142 and 143. In general, base layer 141 may be formed from any of a variety of materials that impart thermal insulation and buoyancy during aquatic activities. As an example, base layer 141 may incorporate a polymer foam material, such as neoprene, which is also referred to as polychloroprene. Neoprene is a synthetic rubber produced by the polymerization of chloroprene. Although non-foamed neoprene may be utilized, neoprene may also be foamed (e.g., with nitrogen gas or other foaming processes) to form gas cells within base layer 141, which enhance the thermal insulation and buoyancy properties of wetsuit 100. Other expansion processes may also be utilized, including a natural foaming process. Examples of additional suitable materials for base layer 141 include other foamed polymer materials (e.g., polyurethane, ethylvinylacetate), various types of rubbers (e.g., sponge rubber, natural rubber, non-foamed rubber), and polymer sheets.

Backing layers 142 and 143 may be formed, in general, from any of a variety of materials that impart strength and abrasion-resistance to wetsuit 100. As an example, backing layers 142 and 143 may be formed from various textiles (e.g., woven, knit, nonwoven), including textiles incorporating nylon. An advantage to nylon relates to its overall durability (e.g., strength, abrasion-resistance), but the textiles of backing layers 142 and 143 may be formed from filaments, fibers, or yarns that include a wide range of materials, including acrylic, cotton, elastane (or spandex), polyamide, polyester, rayon, silk, wool, or combinations of these material. In some configurations, backing layers 142 and 143 may incorporate titanium, carbon fibers, ultrahigh molecular weight polyethylene, or aramid fibers. In addition, polymer sheets or mesh materials may be utilized for backing layers 142 and 143. In some configurations, backing layers 142 and 143 may be formed from the same material or materials. In other configurations, different materials may be utilized for backing layers 142 and 143 to impart different properties to surfaces 101 and 102.

Wetsuit 100 may be formed through any of various manufacturing processes. In general, however, material elements 140 are formed and cut to their appropriate shapes and sizes, and then material elements 140 are joined at seams 144 through one or more of adhesive bonding, thermal bonding, taping, and stitching (e.g., blind stitching). Many aspects of the manufacturing processes are commonly utilized in producing wetsuits, including (a) forming material elements with base layers and backing layers and (b) joining the material elements. Further manufacturing processes are discussed below in conjunction with the descriptions of respective disclosed wetsuit features.

A surfer typically spends the majority of his time in the water paddling, for example, paddling away from shore to get to a suitable location to catch waves, or paddling toward shore to catch waves. Thus, a large amount of a surfer's energy is spent paddling. The amount of effort a surfer makes paddling depends on a number of factors, most of which boil down to hydrodynamic drag. A large amount of drag results from turbulent water that collects on top of the surfboard in front of the surfer's chest. This collection of water is most significant during the surfer's first few strokes, for example, when accelerating from a stationary position to catch a wave, as the board is more submerged when stationary, and rises out of the water after a few strokes as the board speed increases, producing a hydroplaning effect.

Figure 5:
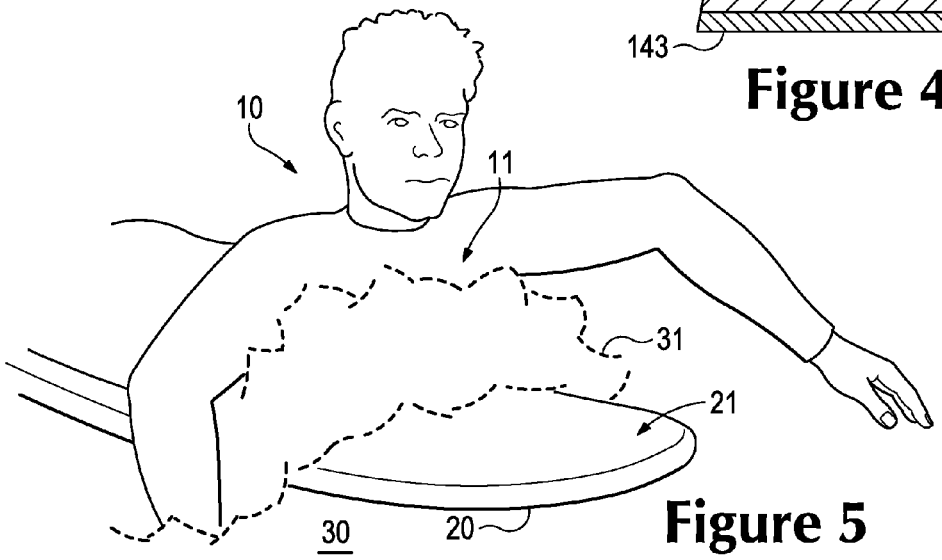
FIG. 5 is an illustration of a surfer paddling in the water on a surfboard, shown from a front perspective view.

FIG. 5 illustrates a surfer 10 paddling a surfboard 20 in the water 30, executing an acceleration to catch a wave. As shown in FIG. 5, turbulent water 31 may collect above the top surface 21 of surfboard 20 in front of the surfer's chest 11. After the first few strokes, the forward motion of the surfer causes the board to hydroplane to some extent, thus raising the surfer and board out of the water more, thereby reducing the amount of water that collects in front of the surfer's chest. However, when catching a wave, the surfer might only need a few strokes, and the faster a surfer can get moving with those strokes, the more likely they will be able to successfully catch a given wave. Therefore, it would be desirable to reduce the amount of drag created by the collection of water in front of a surfer's chest. Further, the less energy required to overcome the drag created by water collecting in front a surfer's chest, the more energy the surfer will have to continue surfing longer, and the more energy they will have to ride waves once they catch the waves.

Figure 6:
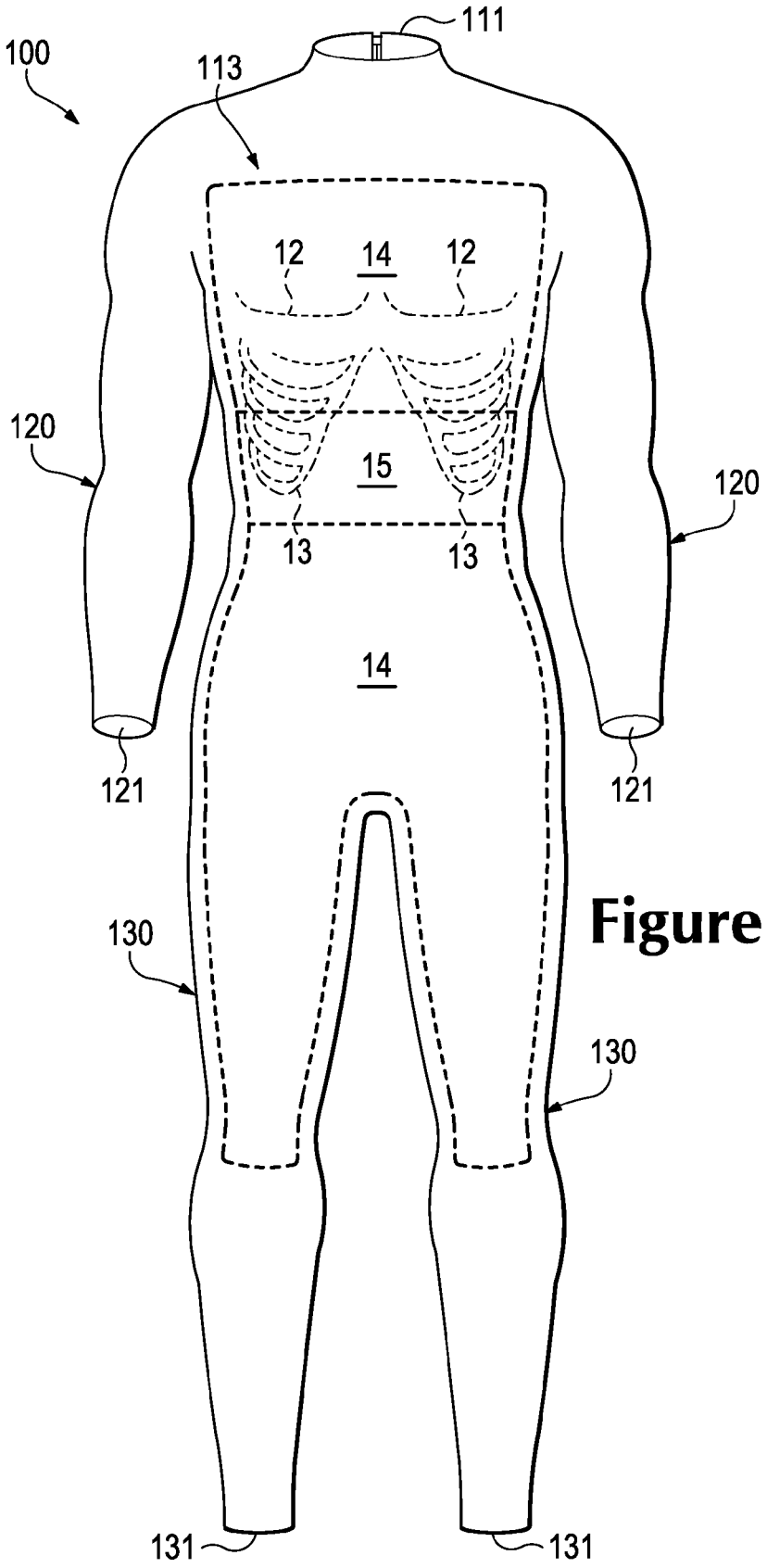
FIG. 6 is an anterior view of a wetsuit, illustrating a contact patch between the wetsuit and a surfboard during paddling.

In addition, surfers often experience discomfort when laying on the board, commonly in the area of the lower chest, where the bottom of the rib cage contacts the board. FIG. 6 illustrates a typical contact patch 14 where wetsuit 100 makes contact with a surfboard during paddling. FIG. 6 shows the approximate location of pectoral muscles 12 when suit 100 is worn by a surfer. In addition, FIG. 6 also shows the approximate location of the lower end of a surfer's rib cage 13 when suit 100 is worn by a surfer. FIG. 6 further shows a hotspot 15 that generally corresponds with ribcage 13. Because of hotspot 15, it would be desirable to provide cushioning and/or to redistribute the contact patch between the surfer's chest and the board.

Chest Pads

Figure 7:
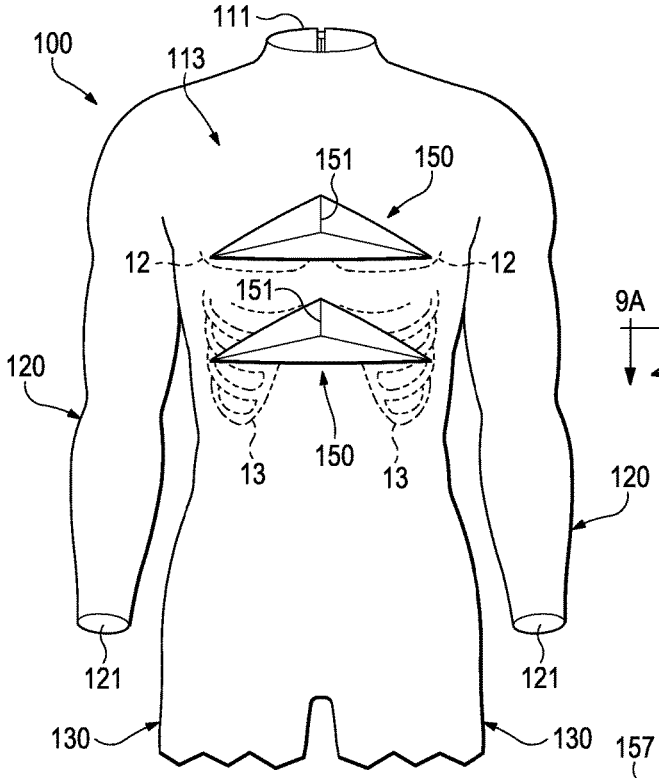
FIG. 7 is an anterior view of a wetsuit having water diverting chest pads.

FIG. 7 illustrates a configuration of wetsuit 100 including one or more chest pads 150 located on an anterior portion of wetsuit 100 on a chest region 113 of wetsuit 100, which may be associated with a surfer's chest, when worn by the surfer. Chest pads 150 may provide cushioning, and thus, comfort for surfers while lying on the surfboard paddling.

In order to provide cushioning, in some configurations, chest pads 150 may be compressible. For example, in some configurations, chest pads 150 may be formed of foam rubber, neoprene, or other compressible materials. Those having ordinary skill in the art will recognize other suitable materials for chest pads 150. In some configurations, chest pads 150 may be formed of a relatively stiffer or incompressible material, such as rubber or plastic. In some configurations, chest pads 150 may include other cushioning structures, such as bladders filled with gases and/or gel. Gas-filled bladders may provide not only cushioning, but also buoyancy, which may also be desirable for surfers.

The placement of one or both of chest pads 150 may be predetermined relative to an anticipated location of the lower end of the wearer's rib cage, an area in which surfers commonly experience discomfort. For example, in some configurations, chest pad 150 may be located in a region corresponding with the lower end of a rib cage of a wearer to provide cushioning. In other configurations, chest pad 150 may be located in a region superior to a lower end of a rib cage of a wearer, in order to redistribute pressure to other portions of the wearer's chest away from the hot spot at the lower end of the rib cage.

In some embodiments, the compressibility of chest pad 150 may vary within the pad itself. For example, in some configurations, the compressibility of chest pad 150 may vary in a lateral direction and/or in a superior-inferior direction. Alternatively, or additionally, the compressibility of chest pad 150 may also vary through the thickness of chest pad 150. For example, in some configurations, a more compressible material may be utilized on a posterior portion (the portion closer to the chest) of chest pad 150. In such embodiments, a relatively harder and/or incompressible material may be used for the anterior (outer) portion of chest pad 150. This configuration may provide a kind of protective outer armor, having a comforting cushion on an inner side, such as found in football or hockey pads.

In addition to providing cushioning, chest pads 150 may be configured to divert water around the torso of the surfer. Water diverting chest pads 150 may include a prow 151, disposed at a superior portion of chest pads 150, configured to divide water collected in front of the surfer's chest, and route the water from the chest region 113 in a lateral direction as the surfer moves forward through the water. Chest pads 150 may divert the water to either side of the surfer's body, in the manner of a boat hull.

Figure 8:
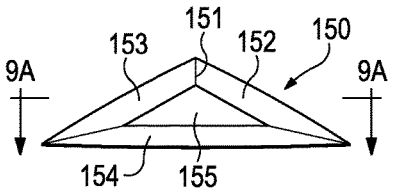
FIG. 8 is an illustration of a water diverting chest pad for inclusion on a chest region of a wetsuit.

FIG. 8 shows another view of a chest pad 150. As shown in FIG. 8, chest pad 150 may include a left-angled, superior surface 152 and a right-angled, superior surface 153, which intersect at prow 151. As further shown in FIG. 8, in some configurations, surface 152 and surface 153 may be left-angled and right-angled, respectively, with respect to a vertical axis. In addition, in some configurations, surface 152 and 153, as well as an inferior surface 154 may be sloped, that is, these surfaces may be angled with respect to a normal direction relative to the surface of suit 100. This sloped configuration of surfaces 152 and 153 may contribute to the hydrodynamic advantages of chest pad 150. In addition, the sloped configuration may also provide aesthetic properties.

Chest pad 150 may have a peaked or substantially flattened configuration. For example, FIG. 7 illustrates a peaked configuration of chest pads 150, in which the facets or sides of each chest pad 150 converge at a peak. When the surfer lays their chest on the board, the peak of chest pad 150 may compress, thus creating an anterior surface 155, as shown in FIG. 8. In some configurations, chest pad 150 may be configured with a substantially flattened anterior surface 155 to begin with (before compression).

Chest pad 150 may have any suitable thickness. For example, in some compressible configurations, chest pad 150 may have a thickness that is approximately 2.5 cm or less when uncompressed, and a thickness of approximately 1 cm or greater when compressed. This compressed thickness may apply when chest pad 150 is fully compressed or when chest pad 150 is compressed By maintaining a minimal thickness when compressed, chest pad 150 may provide cushioning and/or protection to the wearer when significant weight and/or impacts are applied to chest pad 150 during use.

Chest pad 150 may have any suitable size. That is, chest pad 150 may have any suitable length in the superior-inferior direction. Also, chest pad 150 may have any suitable width in the lateral direction. In some configurations, the width of chest pad 150 may be limited in order to ensure that chest pad 150 does not restrict the range of motion of the arms during paddling. In configurations including multiple chest pads, the chest pads may have the same, substantially the same, or different configurations with respect to any of the attributes discussed herein.

Figure 9A:
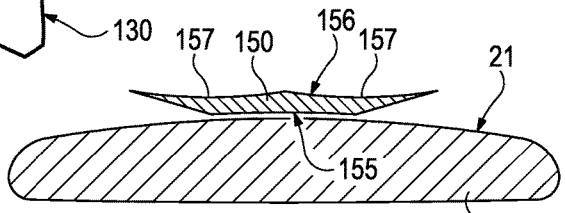
FIGS. 9A and 9B show cross-sectional views of the chest pad shown in FIG. 8 taken at line 9-9 in FIG. 8, and further show the relationship between the exemplary chest pads and a surfboard.

FIG. 9A is a cross-sectional view of pad 150 shown in FIG. 8, in conjunction with a surfboard 20. As shown in FIG. 9A, in some configurations, anterior surface 155, as well as a posterior surface 156 (i.e., the surface that faces the chest of the wearer) may have a pre-formed, contoured shape. Anterior surface 155 may be contoured, for example, curved in a lateral and/or longitudinal direction, in a concave fashion, to substantially correspond with the top surface 21 of surfboard 20. As shown in FIG. 9A, anterior surface 155 may have a lateral curvature (see FIG. 13C discussed below for an exemplary curvature in the superior-inferior direction) configured to receive a convex (in a lateral direction) curvature of a top surface of a surfboard. Contouring of anterior surface 155 in a concave fashion may provide stability for the surfer when lying on the board.

As further illustrated in FIG. 9A, posterior surface 156 may have a pre-formed, contoured shape, configured to correspond with the anatomical shape of the chest of a wearer. For example, in some configurations, posterior surface 157 may be contoured to accommodate the musculature of a wearer. As shown in FIG. 9A, posterior surface 156 may have a convex curvature, and thus, may include recesses 157 configured to receive pectoral muscles. In other configurations, posterior surface 156 may have a single curved contour configured to generally receive the curvature of a surfer's torso. Contouring of posterior surface 156 may provide several advantages, including improved comfort. In addition, contouring of posterior surface 156 may also provide improved fit, which may, in turn, provide improved hydrodynamics, by reducing drag caused by a loose fitting wetsuit. In still other configurations, posterior surface 156 may be substantially planar.

Figure 9B:
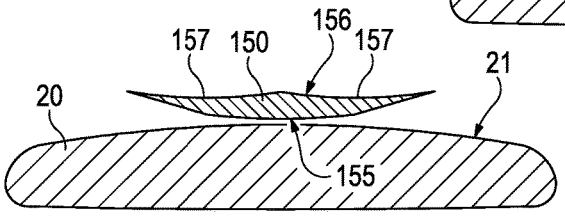

FIG. 9B shows an alternative configuration in which anterior surface 155 may be contoured in a convex fashion in a lateral direction. This convex curvature may facilitate paddling, by enabling the surfer to rock back and forth, in a side to side (lateral) direction on the board, while paddling. This may make it easier for the surfer to reach into the water with each hand, thus reducing the amount of energy required for each paddle stroke. In addition, the convex anterior surface 155 may also enable the surfer to reach their arms further into the water, thereby enabling a deeper, and therefore more propulsive, paddle stroke.

In some configurations, anterior surface 155 may include one or more frictional features. For example, anterior surface 155 may have a rubberized or silicone coating that interacts with wax on the top surface of the surf board. In some embodiments, anterior surface 155 may be textured and/or may have other types of anti-slip coatings.

Figure 10:
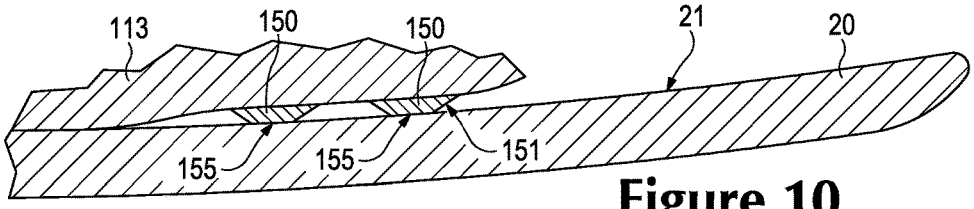
FIG. 10 is a cross-sectional view of a wetsuit having chest pads resting against a surfboard, the cross-section taken along a longitudinal axis of the wetsuit and facing in a lateral direction.

FIG. 10 shows a lateral cross-sectional view of a surfer's chest 11, lying on chest pads 150 on top of surf board 20. As shown in FIG. 10, during use, anterior surface 155 of chest pads 150 may rest on top surface 21 of surf board 20.

Figure 11:
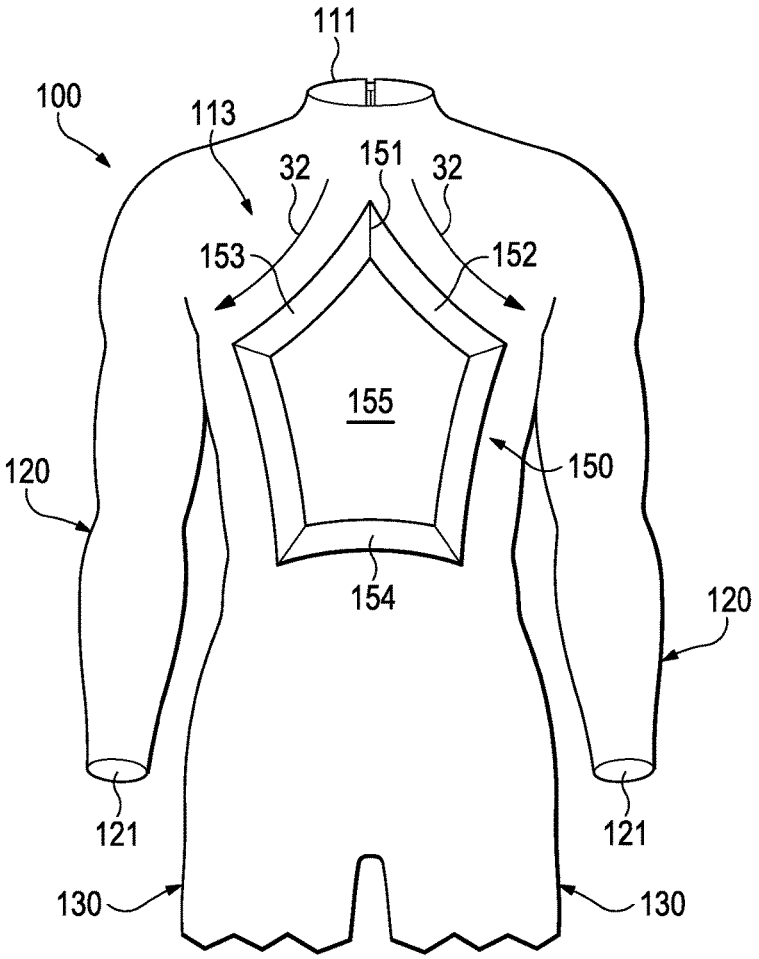
FIG. 11 is an anterior view of a wetsuit having a water diverting chest pad with another configuration.

FIG. 11 shows an exemplary wetsuit 100 having an alternative configuration of chest pad 150. As shown in FIG. 11, in some configurations, wetsuit 100 may include a single, larger chest pad 150. A larger chest pad 150, such as shown in FIG. 11, may provide padding over a larger surface area and may, in some cases, provide the advantage of reducing drag by preventing water from flowing into the space between the torso of the surfer and the board, particularly in the abdominal area and/or in the lateral portions of the torso where the body curves up and away from the surfboard, creating space for water. That is, chest pad 150 may be configured to occupy the space between the lateral portions of the torso and the surf board.

Figure 12:
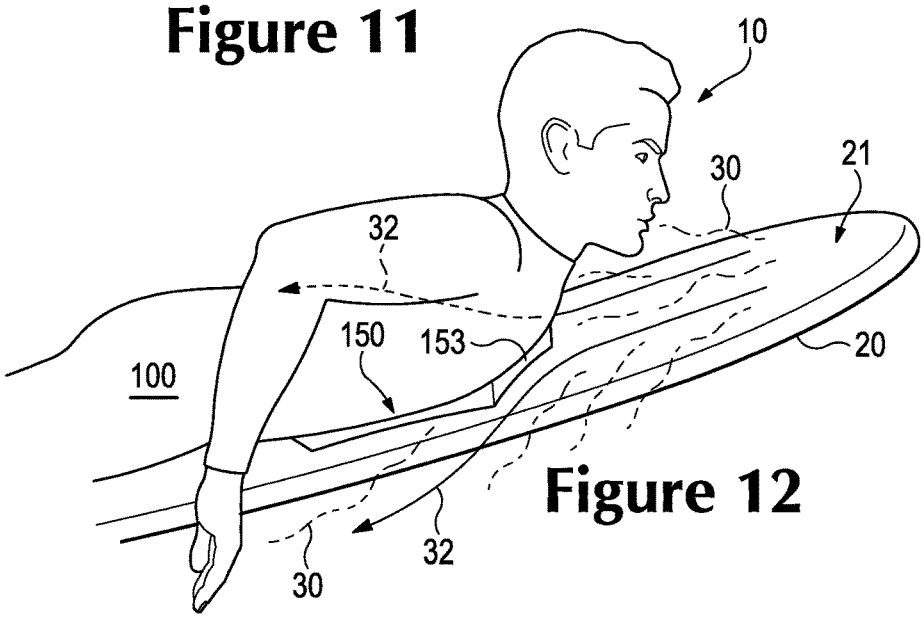
FIG. 12 illustrates a lateral view of a surfer paddling on a surfboard wearing the wetsuit shown in FIG. 11.

FIG. 12 illustrates water being diverted by chest pad 150 during paddling. Water that would typically collect in front of a surfer's chest resulting in increased drag during paddling may be diverted in the lateral directions by chest pad 150, as illustrated by arrows 32 in FIG. 12.

Figure 13A:
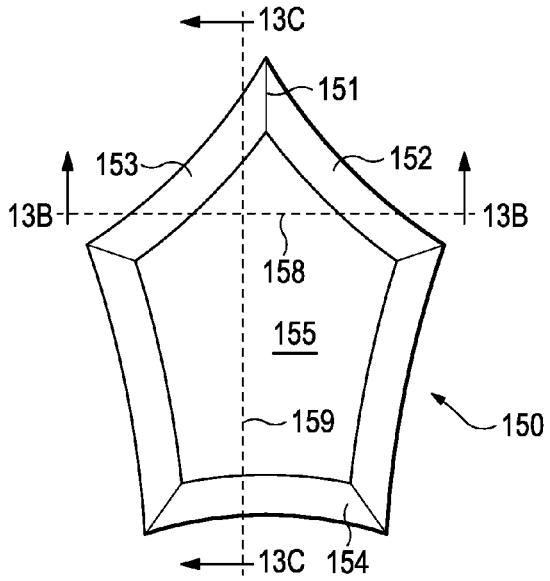
FIGS. 13A-13C are anterior and cross-sectional views of the chest pad of the wetsuit shown in FIG. 11.

Chest pad 150 may have any suitable shape. For example, as shown in FIG. 13A, chest pad 150 may have a pentagonal shape. In other configurations, other polygonal shapes may be possible, such as triangular (as shown in the configuration of FIG. 7), diamond-shaped, or other suitable shapes. It should be noted that the number and configuration of the sides of chest pad 150 may be provided in any suitable configuration that includes a prow (151), a left-angled surface (152), and a right angled surface (153) for diverting water from the chest region 11 of the surfer to the sides of the surfer.

It will also be noted that the sides (i.e., surfaces such as 152, 153, 154) may have any configuration suitable for the purpose of diverting water, reducing drag, and creating body lift for the surfer. For example, in some configurations, side surfaces (for example surfaces 152, 153, and 154) of chest pad 150 may be relatively straight (planar), as shown in FIG. 7. In other configurations, the side surfaces (for example surfaces 152, 153, and 154) of chest pad 150 may be curved. For example, as shown in FIG. 13A, surfaces 152, 153, and 154 may have a concave curvature. This configuration may function, hydrodynamically, similar to a snow plow, which can have a similar configuration with a prow and concave opposing diverting surfaces. In other configurations, surfaces 152, 153, and 154 may have a convex configuration (not shown). Such a configuration may function, hydrodynamically, similar to the bow of a boat hull.

The angle of left-angled surface 152 and right-angled surface 153 with respect to a medial axis (i.e., the axis extending in a superior-inferior direction along the midline of the body) of the wetsuit 100 may vary. Different angles with respect to the medial axis may divert water better or worse depending on other aspects of the chest pad configuration, such as the size and placement of the chest pad, as well as other factors.

In addition, the angle of left-angled surface 152 and right-angled surface 153 with respect to the direction normal to exterior surface 101 may also vary. Hydrodynamically, this angle may influence the diversion of water, as well as provide body lift to the surfer. Those having ordinary skill will recognize suitable angles, both with respect to the medial axis and with respect to the direction normal to exterior surface 101, to reduce drag, for example, by increasing water diversion and/or body lift.

Figure 13B:
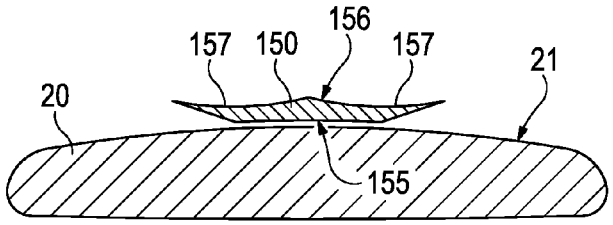

FIG. 13B is a cross-sectional view of the chest pad 150 shown in FIG. 13A, taken in a lateral direction through medial-lateral axis 158 in FIG. 13A. As shown in FIG. 13B, the chest pad configuration shown in FIG. 13A may have the same or similar lateral cross-sectional shape as the configuration shown in FIG. 7 and FIG. 9A (for example, having a concave anterior surface 155, as shown in FIG. 13B). Like the configuration shown in FIG. 7, the chest pad configuration shown in FIG. 13A may, alternatively, have a planar anterior surface 155, or a convex anterior surface 155, such as the configuration shown in FIG. 9B.

Figure 13C:
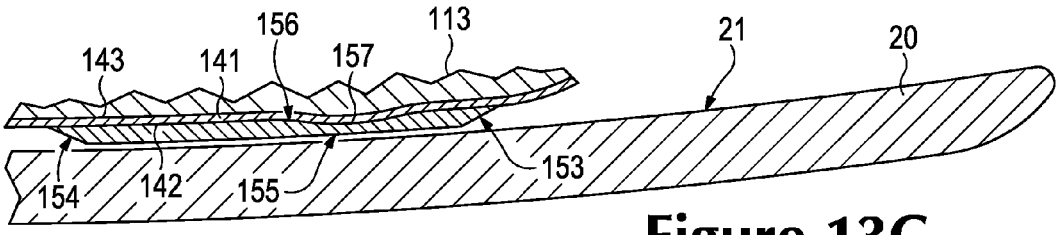

FIG. 13C shows a cross-sectional view of the chest pad configuration of FIG. 13A, taken in a superior-inferior direction, at superior-inferior axis 159 in FIG. 13A. As shown in FIG. 13C, anterior surface 155 of chest pad 150 may have a convex curvature in a superior-inferior direction. Such a convex curvature may correspond with the concave longitudinal curvature of top surface 21 of surf board 20, as shown in FIG. 13C. In some configurations the longitudinal cross-section of anterior surface 155 of a larger chest pad 150, such as shown in FIG. 13A, may be substantially linear.

Chest pads having configurations such as those discussed above may provide benefits in comfort, hydrodynamics, buoyancy, and aesthetics. Chest pads may provide comfort by cushioning hot spots where surfers commonly experience discomfort, such as the lower portion of the ribcage. Also, chest pads positioned elsewhere (i.e., at locations other than at the hot spots) may relieve pressure and/or eliminate contact between the hot spots and the board.

Chest pads having a prow, a left-angled surface, and a right-angled surface, may divert water around the torso of a paddling surfer to improve hydrodynamics and reduce drag. In addition, the shape and angles of chest pad surfaces may provide hydrodynamic lift, which may support some of the surfer's body weight, reducing the weight on the surf board. Reducing the weight on the surf board may lift the surfer and board so that less of the board and surfer are submerged, which results in reduced drag.

In addition, the material construction of chest pads may increase buoyancy of the wetsuit. For example, a foam rubber, neoprene, or gas filled pad may increase the buoyancy of the wetsuit, which may have a similar effect as hydrodynamic lift. sides around body (hydrodynamics) like a boat hull to reduce drag; angled surfaces create lift of wearer's body, taking pressure off ribcage; provides cushion; relocates contact area to other portion of chest (e.g., on pecs (soft tissue) instead of lower ribs).

Another advantage of chest pads 150 relates to enhancing the aesthetic properties of wetsuit 100. In addition to providing the structural advantages of providing comfort, reducing drag, and producing body lift, as noted above, chest pads 150 may also be utilized to enhance the visual appearance of wetsuit 100. For example, in some configurations, chest pads 150 may be formed from materials with different colors or contrasting materials to accentuate the presence of chest pads 150. Accordingly, chest pads 150 may impart both structural and aesthetic advantages to wetsuit 100

Sipes

Wetsuit 100 may include other features that reduce drag. For example, in some configurations, wetsuit 100 may include a plurality of sipes configured to divert water from the chest region and, accordingly, provide similar hydrodynamic benefits as chest pads 150. FIG. 14 shows an exemplary configuration of a plurality of sipes 160 in chest region 113 of wetsuit 100. At least some of sipes 160 may extend from an upper portion of chest region 113 of wetsuit 100 to a lateral portion of chest region 113.

Sipes 160 may provide hydrodynamic benefits in a number of ways. First, sipes 160 may provide a path for water accumulating in front of a surfer's chest while paddling to be evacuated. That is, sipes 160 may be configured to allow water to flow between the surfer's chest and top surface 21 of surf board 20. By providing a drainage route allowing for the reduction in the accumulation of water in front of a surfer's chest, sipes 160 may reduce drag during paddling.

Additional hydrodynamic advantages may be provided by sipes 160 for water flowing over a portion of a surfer's chest that is not in contact with a surf board. For example, sipes 160 may reduce drag, by facilitating the rapid flow of water over chest region 113 of wetsuit 100. Sipes 160 may provide similar benefits to the small grooves in shark skin scales, which allow sharks to slip through the water with minimal drag. Over smooth surfaces, fast-moving water begins to break up into turbulent vortices, or eddies, in part because the water flowing at the surface of an object moves slower than water flowing further away from the object. This difference in water speed causes the faster water to get "tripped up" by the adjacent layer of slower water flowing around an object, just as upstream swirls form along riverbanks. Sipes 160 may reduce eddy formation in several ways.

Sipes 160 may reinforce the direction of flow by channeling it. In addition, sipes 160 may speed up the slower water at the wetsuit surface (because the same volume of water moving through a narrower channel increases in speed), reducing the difference in speed of this surface flow and the water just beyond the wetsuit surface. Further, sipes 160 may pull faster water towards the wetsuit surface so that it mixes with the slower water, further reducing this speed differential. Also, sipes 160 may divide up the sheet of water flowing over the wetsuit surface so that any turbulence created results in smaller, rather than larger, vortices.

In some configurations, sipes 160 may be curved. For example, sipes 160 may include superior ends in the upper portion of chest region 113, and sipes 160 may extend from the superior ends in a generally inferior direction and may curve toward inferior ends in the lateral portion of chest region 113. In other configurations not shown, sipes 160 may be relatively linear, for example, extending from a medially disposed superior end to a laterally disposed inferior end.

In some configurations, wetsuit 100 may include a plurality of sipes 160 spaced from one another, a shown in FIG. 14. In some configurations, sipes 160 may include at least two sipes wherein a first sipe is substantially parallel to a second sipe, as shown in FIG. 14. In other configurations, adjacent sipes may be non-parallel. For example, adjacent sipes may taper closer together or further apart toward either end. The spacing between sipes 160 may vary depending on the anatomical location of the sipes. That is, the spacing of the sipes may be optimized considering the contours of the surfer's body.

As also shown in FIG. 14, wetsuit 100 may include a first set of sipes (for example on a right side of chest region 113) including at least a first sipe and a second sipe. Wetsuit 100 may also include a second set of sipes (for example on a left side of chest region 113) including at least a third sipe and a fourth sipe spaced from the third sipe. The first set of sipes may extend from the upper portion of chest region 113 to a right lateral portion of chest region 113 of wetsuit 100. The second set of sipes may extend from the upper portion of chest region 113 to a left lateral portion of chest region 113.

As shown in FIG. 15A, in some configurations, sipes 160 may be formed by linear slits 161 cut a predetermined depth into wetsuit 100 while in a substantially planar arrangement. As illustrated in FIG. 15B, because the slits 161 extend linearly from a first surface of the exterior backing layer 142, through the exterior backing layer 142 and into the base layer 141, they may open to form sipes 160 having a substantially v-shaped cross-sectional shape when wetsuit 100 is worn with the portion of wetsuit 100 including slits 161 located over a convex body surface of a wearer.

Sipes 160 may be formed using any other suitable cutting device. For example, sipes 160 may, alternatively, be formed by (a) a laser cutting apparatus, (b) a blade that forms a shallow incision in exterior backing layers 142, (c) a router that cuts grooves in exterior backing layer 142, (d) a hydro-cutting apparatus that directs a focused stream of water or another liquid, or (e) a die-cutting apparatus that compresses and cuts areas of exterior backing layers 142. These processes may also be utilized to shape the various material elements 140. In some manufacturing processes, a variety of different methods may be utilized to form sipes 160 and to shape material elements 140.

In the manufacturing processes discussed above, backing layers 142 and 143 are joined to base layer 141 prior to forming sipes 160. In other processes, however, sipes 160 may be formed in exterior backing layer 142 prior to joining exterior backing layer 142 with base layer 141. That is, a laser-cutting apparatus, blade, router, hydro-cutting apparatus, or die-cutting apparatus, for example, may be utilized to impart incisions, cuts, spaces, or other features that form sipes 160 in exterior backing layer 142, and then exterior backing layer 142 may be joined to base layer 141. Additionally, sipes 160 may be formed by joining two spaced and separate elements of exterior backing layer 142 with base layer 141. Similarly, sipes 160 may be formed in exterior backing layer 142 prior to joining with base layer 141. Accordingly, various processes may be utilized to form sipes 160. Such processes are further discussed in U.S. patent application Ser. No. 13/213,634, filed 19 Aug. 2011, entitled "Siped Wetsuit," the entire disclosure of which is incorporated herein by reference.

In other configurations, sipes 160 may be formed as channels in wetsuit material, as shown in FIGS. 16A through 16C. As further illustrated in FIGS. 16A through 16C, sipes 160 may have any suitable cross-sectional shape. For example, as shown in FIG. 16A, sipes 160 may be formed as a v-shaped channel in the wetsuit material. In other configurations, alternative cross-sectional shapes may be utilized, such as semi-circular as shown in FIG. 16B, rectangular as shown in FIG. 16C, or any other suitable shape. In addition, the cross-sectional shape, width, and/or depth of sipes 160 may vary along the length of sipes 160.

In some configurations, sipes 160 may extend through multiple layers of wetsuit 100. As shown in FIGS. 14-16C, in some configurations, sipes 160 may extend through exterior backing layer 142 into base layer 141. In some configurations sipes 160 may extend through more or fewer layers, depending upon the configuration of the layers of wetsuit 100.

Sipes 160 may have a depth that provides desirable hydrodynamic effects, while preserving the structural integrity of the wetsuit material, as well as maintaining the thermal insulating properties of the wetsuit material. In order to achieve this combination of attributes, a relatively thicker wetsuit material may be preferred. For example, the siped wetsuit concept may be preferably applicable to 3 mm, 4 mm, or 5 mm, although other thicknesses (thicker or thinner) may also implement siping according to the present disclosure.

In some configurations, the depth of sipes 160 may be approximately 60 percent of the total thickness of the wetsuit between the exterior surface and the interior surface. For example, as illustrated in FIG. 16A, sipe 160 may have a depth 162, which may be approximately 60 percent of the thickness 163 of wetsuit 100. In an exemplary configuration, wetsuit 100 may be a 5 mm wetsuit, wherein thickness 163 is approximately 5 mm. In such an embodiment, depth 162 of sipes 160 may be approximately 3 mm. This depth ratio may apply to both channeled sipes, as shown in FIGS. 16A-16C as well as cut sipes formed from slits 161, as shown in FIGS. 15A and 15B.

Paddling Assist Members

Figure 17A:
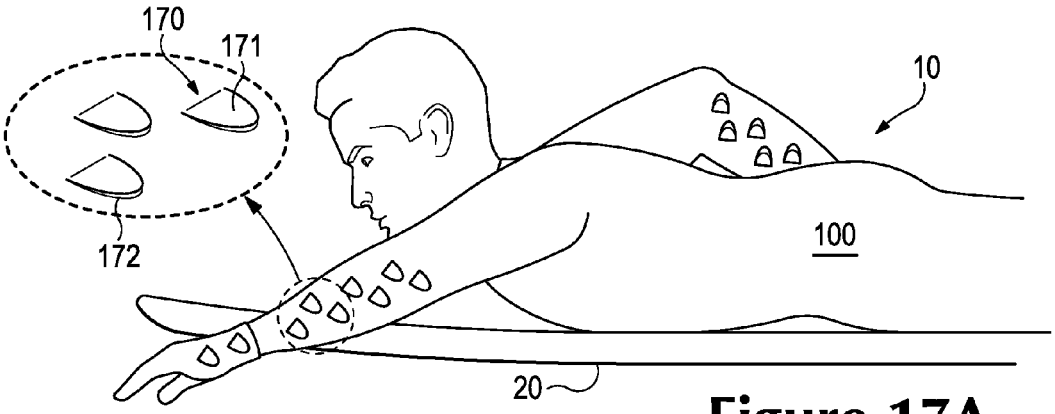
FIGS. 17A-17C illustrate a surfer paddling on a surfboard wearing a wetsuit having a plurality of paddling assist members on the arm region of the wetsuit.
Figure 17B:
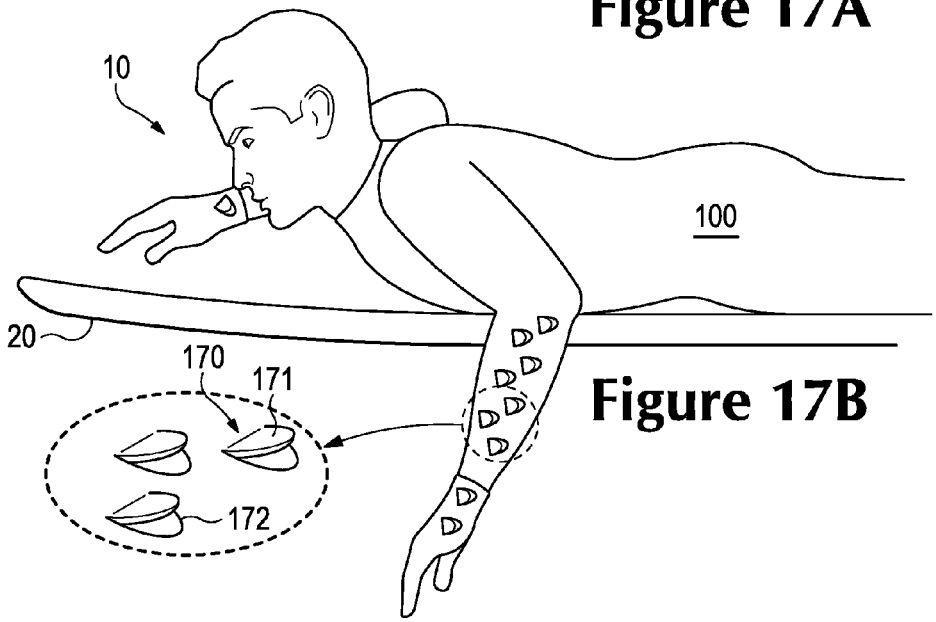
Figure 17C:
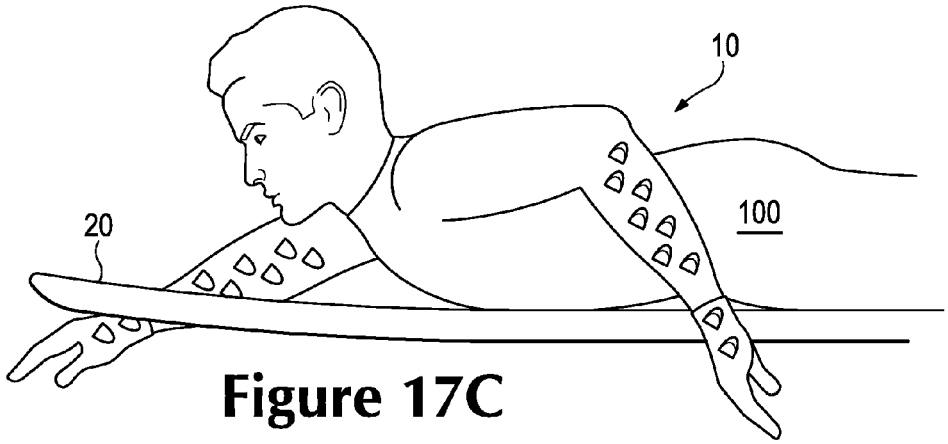

As shown in FIGS. 17A-17C, in some configurations, wetsuit 100 may include paddling assist members 170 disposed on arm regions of wetsuit 100. Paddling assist members 170 may including a flap portion 171 on the exterior surface of wetsuit 100. Paddling assist members 170 may be configured to lay flat while inserting the arm region into water, and extend outward from the surface of wetsuit 100 when the arm region is drawn backward during a paddling stroke movement to provide greater resistance to the movement and, thereby, increase the thrust provided by the movement.

As shown in FIG. 17A, when inserting the arm into the water, flap portions 171 of paddling assist members 170 may lay flat against wetsuit 100 in a streamlined fashion. As shown in FIGS. 17B and 17C, flap portions 171 of paddling assist members 170 may bend outward under the force of drag created as the arm is pulled rearward (toward the tail end of the board).

In some configurations, wetsuit 100 may include a single paddling assist member 170 (e.g., one on each arm), or a plurality of paddling assist members 170. Configurations having a plurality of paddling assist members 170 may include paddling assist members 170 having substantially similar configurations. In some configurations, wetsuit 100 may include a plurality of paddling assist members 170 differing sizes, shapes, and/or orientations.

Paddling assist members 170 may be disposed on arm regions of wetsuit 100 and, in some cases, glove portions of wetsuit 100. Paddling assist members 170 may be selectively located on portions of the arm regions and glove portions in which paddling assistance may be most effective. For example, in some cases, paddling assist members 170 may be disposed on the anterior (palm side) of the forearm, which engages the water during a paddle stroke. In some cases, the posterior (back of the hand side) of the forearm may be substantially devoid of paddling assist members 170. A particularly suitable location for paddling assist members 170 may be at, and around, the junction between the anterior and posterior sides of the forearm. These areas are the lateral-most and medial-most portions of the forearm during a surfer's paddle stroke. Accordingly, paddling assist members 170 disposed in these areas extend outward during the paddle stroke, effectively widening the arm in the direction perpendicular to the direction of the stroke, thereby making the forearm into a larger paddle by increasing the surface area exposed to the water.

In addition, paddling assist members 170 may be disposed on portions of the arm region of suit 100 that will be submerged during at least a portion of the paddle stroke. A surfer's paddle stroke typically submerges the arm approximately up to the surfer's elbow. In some cases, the arm may be submerged slightly more or less than the level of the elbow. In addition, paddling assist members 170 may also be applicable to wetsuits designed for activities other than surfing, such as diving, snorkeling, and other such activities. In some wetsuits, it may be advantageous to locate paddling assist members 170 further up the arms, since more, and in some cases all, of the suit may be submerged during such activities.

Figure 17D:
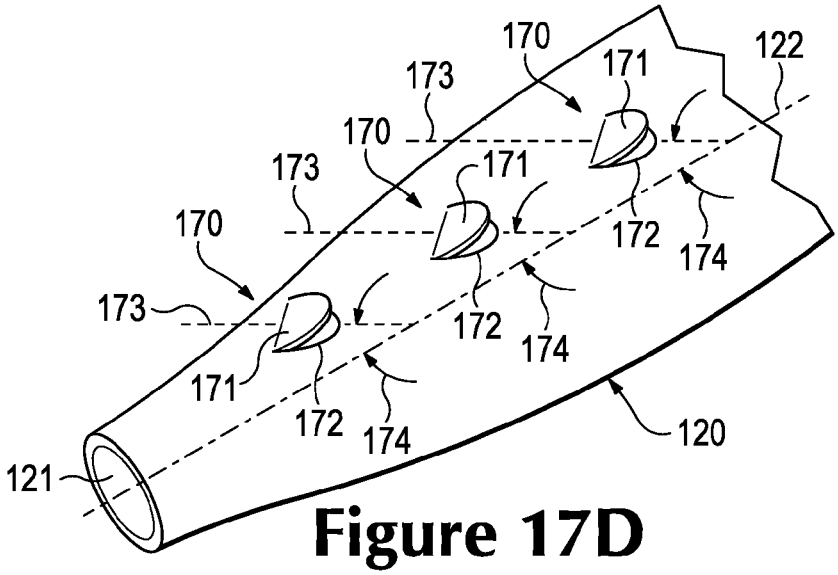
FIG. 17D is an enlarged view of an arm region of a wetsuit having the paddling assist members shown in FIGS. 17A-17C.
Figure 17E:
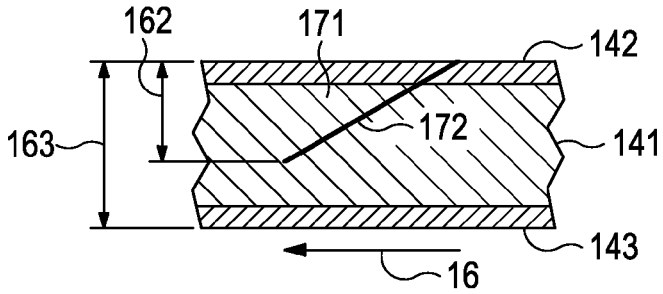
FIGS. 17E and 17F illustrate a paddling assist member having a slit configuration.
Figure 17F:
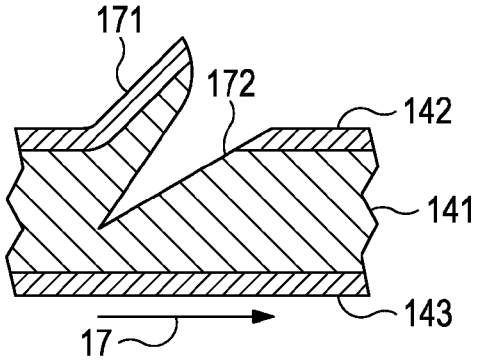

As shown in FIGS. 17D-17F, each paddling assist member 170 may be formed by a cut 172 extending from the exterior surface of wetsuit 100 partially through a thickness of wetsuit 100, thereby forming flap portion 171 attached to wetsuit 100 at one end of flap portion 171. In some configurations, paddling assist members 170 may be oriented in substantial alignment with a longitudinal arm axis 122 of arm region 120 of wetsuit 100. In other configurations, paddling assist members 170 may be oriented in substantial non-alignment with longitudinal arm 122 of arm region 120 of wetsuit 100, as shown in FIG. 17D. For example, paddling assist members 170 may be oriented in alignment with a flap axis 173, as shown in FIG. 17D. As further shown in FIG. 17D, flap axis 173 may be oriented at an angle 174 with respect to longitudinal axis 122. In some configurations, angle 174 may be consistent for each paddling assist member 170. Thus, paddling assist members 170 may be arranged on an arm region 120 of wetsuit 100 may have a substantially similar orientation.

In other configurations, the angle 174 of different paddling assist members 170 may differ. Some configurations of paddling assist members 170 may include one or more localized groups of paddling assist members 170, wherein the paddling assist members 170 in a given group are consistently oriented, and other paddling assist members 170 in other areas may be oriented differently.

In some configurations, the size and/or shape of paddling assist members 170 may be consistent, and thus, wetsuit 100 may include a plurality of paddling assist members 170 having substantially similar configurations. In other configurations, the size and/or shape of paddling assist members 170 may vary.

FIG. 17E shows a paddling assist member 170 laying flat as it would when the wetsuit material is advanced through water in a direction indicated by an arrow 16, for example, when a surfer inserts their arm into the water at the beginning of a paddling stroke. FIG. 17F shows the paddling assist member 170 of FIG. 17E in an extended condition as it would be when the wetsuit material is drawn back through the water in a direction indicated by an arrow 17, for example, when a surfer pulls their arm backward through the water during the thrust portion of a paddle stroke.

FIGS. 17E and 17F also illustrate an exemplary depth of cuts 172 that may be made to form flap portions 171 of paddling assist members 170. Cuts 172 of paddling assist members 170 may have a depth suitable to form flap portion 171 with a desired length, while maintaining the structural integrity and thermal insulating properties of wetsuit 100. To these ends, it may be advantageous to implement paddling assist members 170 on relatively thicker wetsuits, such as 3 mm, 4 mm, 5 mm, or thicker suits, as discussed above regarding sipes 160.

In some configurations, depth 162 of cuts 172 may be approximately 60 percent of the total thickness 163 of wetsuit 100 proximate cuts 172, as shown in FIG. 17E. Other suitable ratios (cut depth to wetsuit thickness) are possible, however, and such ratios may be determined based on considerations discussed above, as well as other factors. As further indicated in FIGS. 17E and 17F, paddling assist members 170 may extend through multiple layers of wetsuit material. For example, as shown in FIGS. 17E and 17F, paddling assist members may extend through external backing layer 142 and into base layer 141.

Cuts 172 may be formed using any suitable cutting device, including blades, lasers, high pressure water cutting devices, or any other suitable cutting device. The formation of cuts in wetsuit material is discussed in detail above with respect to sipes 160. The methods and principles discussed above are generally applicable to the formation of cuts 172 to produce paddling assist members 170.

As shown in FIGS. 18A-18F, in some embodiments, paddling assist members 170 may be formed by a piece of material attached to the exterior surface of wetsuit 100 at one edge of the piece of material, thereby forming a flap 171 attached to wetsuit 100 at one end of flap 171. For example, as shown in FIGS. 18A-18F, a teardrop-shaped piece of material may be attached to external backing layer 142, for example, by adhesive or another suitable fixation. The teardrop-shaped piece of material may be affixed to external backing layer 142 at one end, thereby forming a base region 175 attached to external backing layer 142 and a flap portion 171 detached from external backing layer 142. Flap portion 171 is depicted as lying substantially flat against exterior backing layer 142 in FIG. 18B, and as extending from exterior backing layer 142 in FIG. 18C.

Figure 18A:
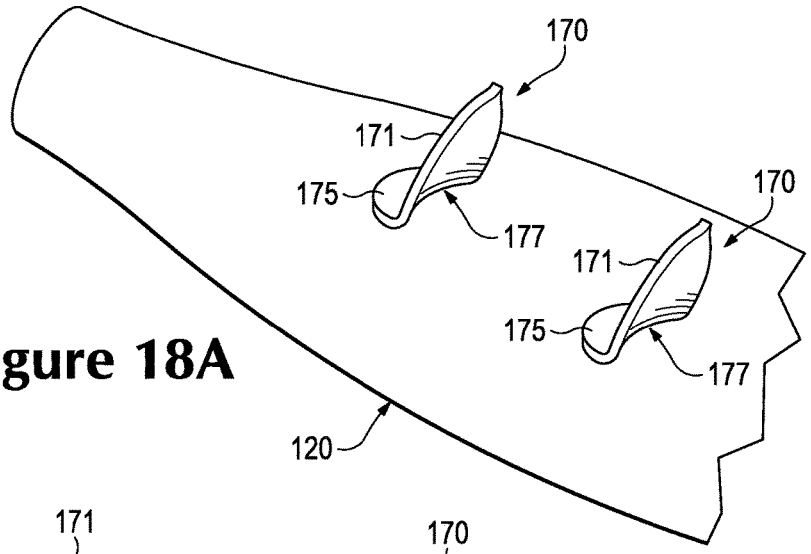
FIGS. 18A-18F illustrate an alternative paddling assist member configuration formed of a separate component affixed to the surface of the wetsuit.
Figure 18B:
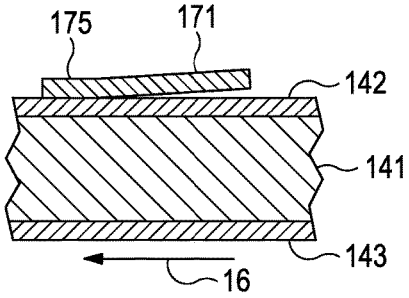
Figure 18D:
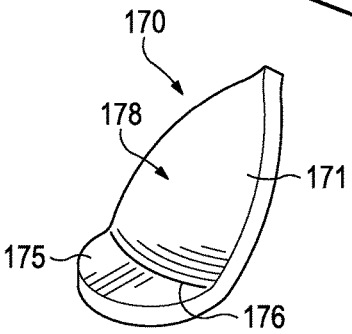
Figure 18C:
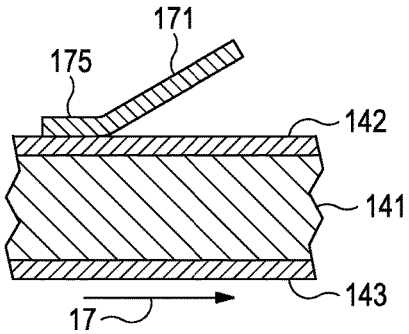
Figure 18E:
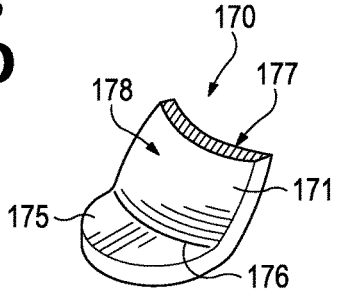
Figure 18F:
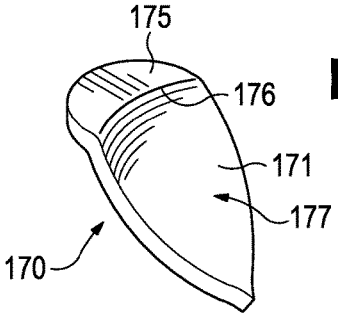

FIGS. 18D-18F illustrate additional views of the paddling assist member 170 shown in FIGS. 18A-18C. As shown in FIG. 18D, paddling assist members 170 may include a base region 175. Base region 175 may have a generally curved edge 176. This curved edge 176 may cause flap portion 171 to become curved when deflected away from exterior backing layer 142, forming a convex surface 178 shown in FIG. 18D and an opposing concave surface 177 shown in FIG. 18F. This curved edge 176 and concave surface 177 may limit the extent to which flap portion 171 may be bent back toward base region 175, thus providing a firm paddling surface. Such an edge 176 and concave surface 177 may have a similar effect to the concavity of a metal carpenter's tape measure, providing strength against bending in one direction without affecting the flexibility of the material in the other direction. This curvature of flap 171 is further illustrated in FIG. 18E, which includes a cross-sectional cutaway view of flap 171.

Interlocking Components

A wetsuit may be formed in multiple components. For example, it is common for wetsuits to include a single component forming the torso, arms, and legs, and additional components for the hands and feet, that is, gloves and booties, as well as a hood or head covering that may attach to the main torso portion, for example at the neck opening. The junctions between these components can be significant factors in the fit and comfort of the wetsuit, and also may play a significant role in ensuring the water tightness of the wetsuit. The following covers exemplary wetsuit configurations that include interlocking wetsuit components for improved connections at the junctions between wetsuit components.

Figure 19:
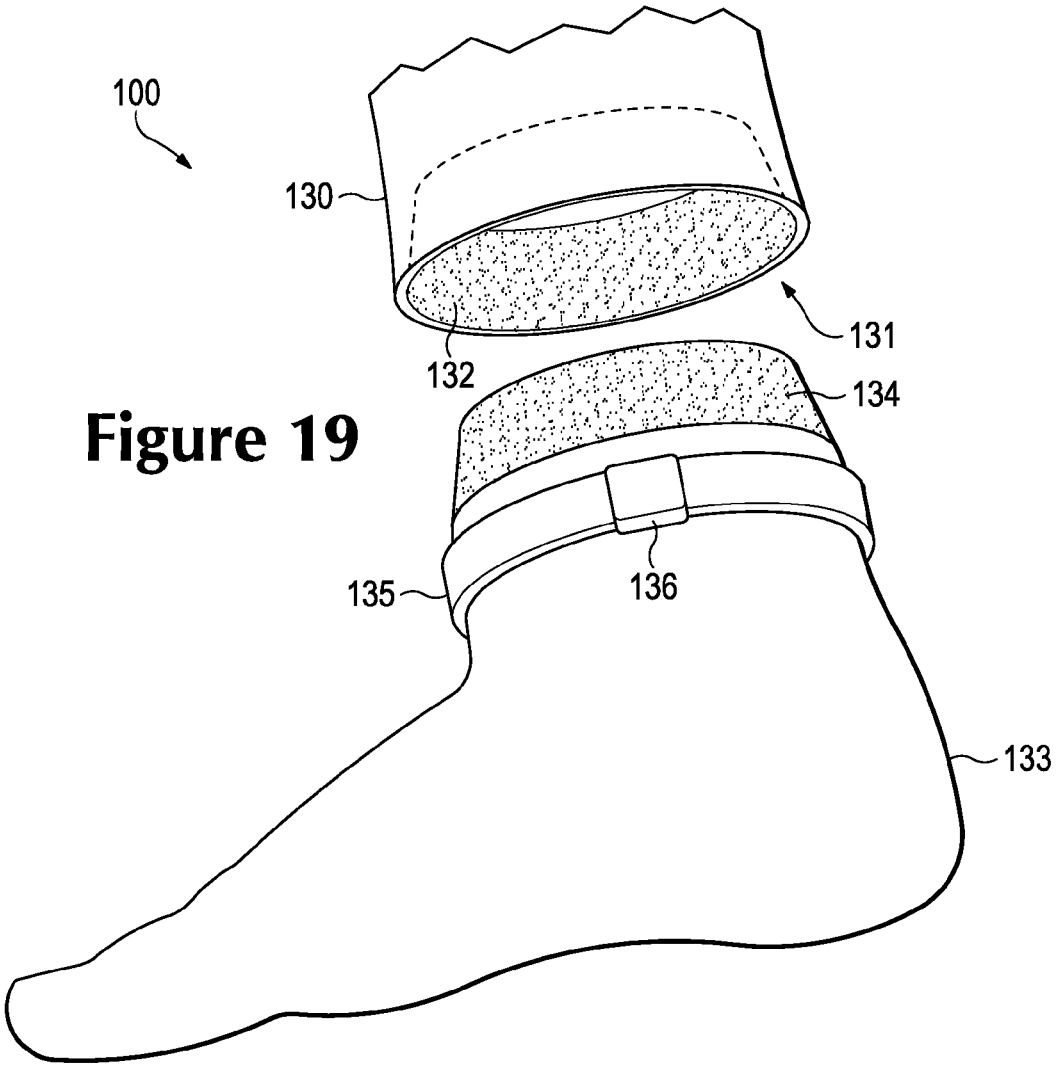
FIG. 19 is a lateral perspective view of a leg portion of a wetsuit and a foot portion of a wetsuit, wherein the leg portion and the foot portion include adjoining edge portions configured to abut one another.

FIG. 19 illustrates a wetsuit component junction between a leg region 130 of a first section of wetsuit 100 and a foot portion 133 forming a second section of wetsuit 100. Leg region 130 and foot portion 133 may be configured to be adjoined together to enclose a portion of the body of a wearer.

As shown in FIG. 19, leg region 130 may include a first adjoining edge portion having a first edge thickness that is less than a thickness of adjacent portions of leg region 130. Foot portion 133 may include a second adjoining edge portion having a second edge thickness that is less than a thickness of adjacent portions of the second section. The first adjoining edge portion and the second adjoining edge portion may be configured to fit together in an overlapping configuration such that the combined thickness of corresponding portions of the edge portions is approximately the same as the thickness of adjacent portions of the first section and the second section.

Figure 20A:
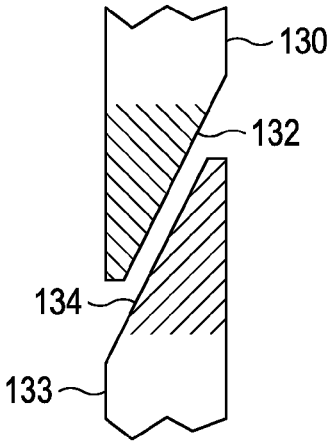
FIGS. 20A and 20B illustrate cross-sectional views of different configurations of the abutting surfaces of the leg portion and foot portion of the wetsuit shown in FIG. 19.
Figure 20B:
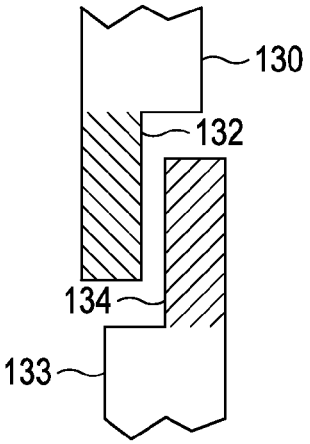

As shown in FIGS. 19 and 20A, leg opening 131 of leg region 130 may include an inner interface surface 132. Similarly, foot portion 133 may include an outer interface surface 134 configured to mate with inner interface surface 132 of leg region 130. As shown in FIGS. 19 and 20A, in some configurations inner interface surface 132 and outer interface surface 134 may have a tapered thickness. Thus, in some configurations, the first adjoining edge portion and the second adjoining edge portion may each have a tapered thickness. In other configurations, inner interface surface 132 and outer interface surface 134 may have a stepped thickness, for example, as shown in FIG. 20B. In some configurations, inner interface surface 132 and outer interface surface 134 may be tacky surfaces configured to abut one another, thus providing increased grip between the surfaces. Any suitable material may be implemented to make surface 132 and 134 tacky, sticky, or otherwise more likely to maintain contact at the junction between leg regions 130 and foot portions 133.

As shown in FIG. 19, wetsuit 100 may include an ankle strap 135 configured to be tightened about the ankle of a wearer, for example, by a fastener 136, such as a buckle. As further shown in FIG. 19, in some configurations, ankle strap 135 may be disposed below outer interface surface 134. This configuration of an ankle strap 135 (the relatively low placement) may improve the seal, as well as the appearance of the junction between leg regions 130 and foot portion 133. Commonly, ankle straps for wetsuit boot portions are positioned relatively high on the ankle and, therefore, end up being covered by the leg regions. This can interfere with the seal at the leg/boot junction. This can also appear unsightly, for example, with a strap and buckle bulging under a leg region 130 of a wetsuit.

Positioning ankle strap 135 in a relatively low location may prevent water from filling the foot portions 133. In addition, water may also be prevented from flowing into foot portions 133 by the orientation of surface 134 to be outwardly facing.

Figure 21:
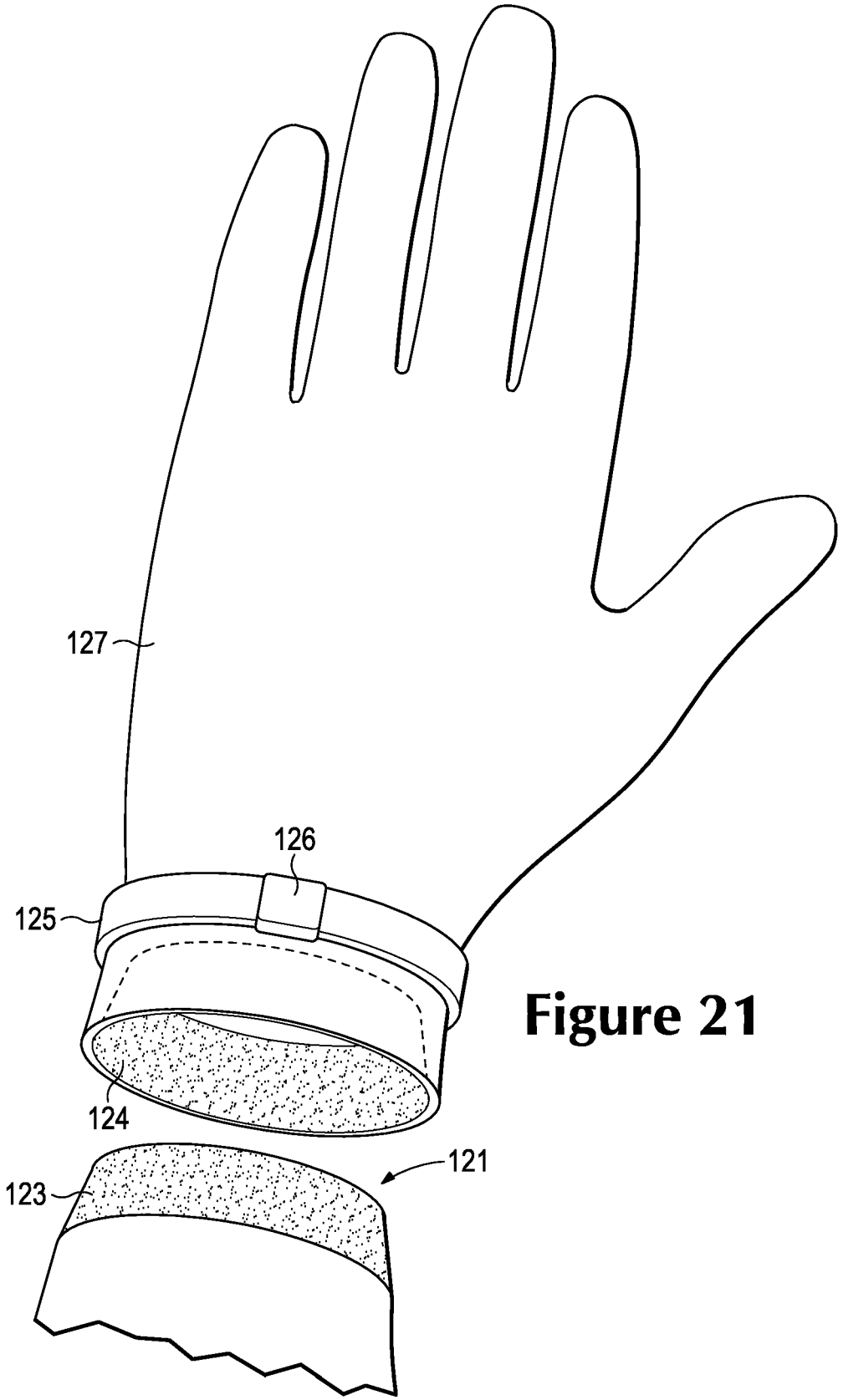
FIG. 21 illustrates a wetsuit arm region and glove portion configured to abut at adjoining edge portions.

FIG. 21 illustrates a similar junction configuration to that in FIG. 19, as implemented for a glove section of a wetsuit. The glove junction may be configured similar to the boot junction in FIG. 19. For example, arm opening 121 may include an outer interface surface 123. A hand portion 127 of wetsuit 100 may include an inner interface surface 124 configured to mate with outer interface surface 123. The illustrated glove configuration also includes a wrist strap 125, as well as a fastener 126, such as a buckle. Wrist strap may configured similarly to ankle strap 135.

Some configurations may include a head portion (e.g., a hood), which may be attachable to a neck opening of a wetsuit in a similar manner as described above with respect to hand and foot portions of wetsuits.

Kinesiology Strips

Kinesiology tape is used by doctors and athletic trainers to provide various benefits to patients and athletes. Kinesiology tape is an elastic tape that is often used on and/or around the joints to provide support to various muscles and connective tissue associated with the joints. The elasticity of the tape allows freedom of movement so athletes can continue to perform their athletic activity and patients can retain full use of the body part in its normal range of motion. The elasticity functions to provide tension and, therefore, supports muscles, ligaments, and tendons, for example, so these tissues experience reduced loading. The reduced loading may enable these tissues to heal, while the athlete may continue to participate in their athletic activity without making the injury any worse. As described in more detail below, the present disclosure envisages the use of elastic strips similar to kinesiology tape as part of a wetsuit in order to provide similar benefits, as well as other advantages to a surfer.

Figure 22A:
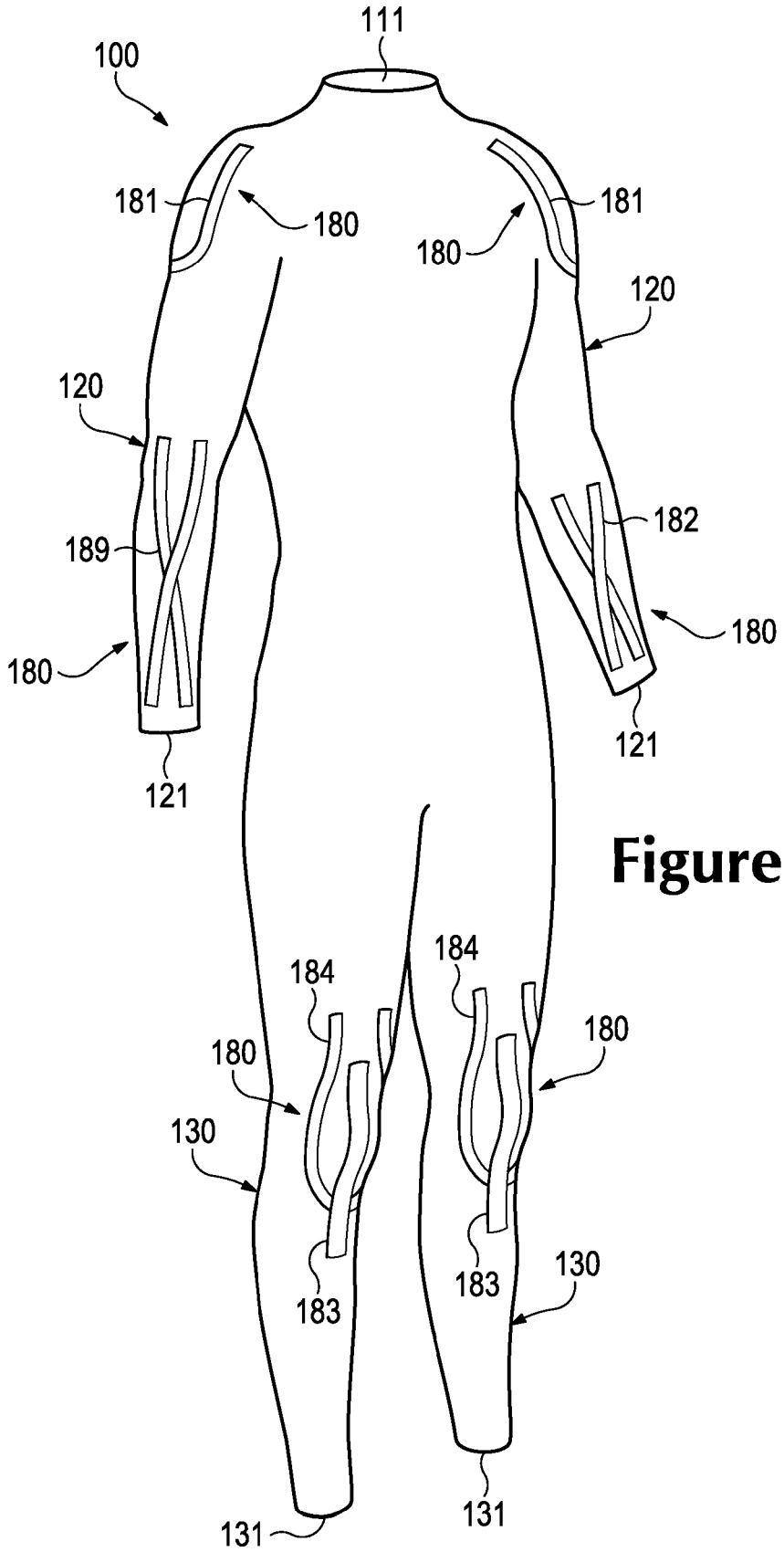
FIG. 22A is an anterior view of a wetsuit including a plurality of kinesiology strips.

FIG. 22A shows an anterior perspective view of a wetsuit 100 having kinesiology strips 180 at multiple joint locations. Kinesiology strips 180 may be elongate, may be formed of an elastic material, and may be incorporated into the wetsuit material in a location and orientation configured to exert tension on the wetsuit (and therefore also exert tension on the wearers body) in a predetermined direction. For example, kinesiology strips 180 may be configured to bias a wearer's body part toward a predetermined anatomical position, such as biasing a knee toward extension or flexion. In addition, the tension exerted on wetsuit 100 by kinesiology strip 180, when worn by a wearer, may supplement the force exerted by musculature that controls the positioning of body parts corresponding with the portion of wetsuit 100 having kinesiology strips 180. For example, elbow strips may support bicep flexion. The advantages of kinesiology strips 180 are discussed in greater detail below.

Kinesiology strips 180 may be attached to wetsuit 100 in any suitable way. For example, in some configurations, kinesiology strips 180 may be attached to the exterior surface of wetsuit 100. For instance, kinesiology strips 180 may be attached to exterior backing layer 142 with adhesive or another means of fixation. Alternatively, or additionally, kinesiology strips 180 may be embedded in the wetsuit material (for example, between layers). Also, kinesiology strips 180 could be disposed on an interior surface of wetsuit 100. Depending on the configuration of a given strip, kinesiology strips 180 may be more or less effective when disposed on an interior or exterior surface of wetsuit 100. Therefore, this may be a consideration when determining where to locate strips.

As shown in FIG. 22A, wetsuit 100 may include shoulder strips 181. Shoulder strips 181 are shown as having a relatively simple horseshoe or U-shaped configuration. However, it will be understood that other configurations may be utilized, such as a single linear strip, criss-crossed strips, or any other suitable configuration. Those having skill in various fields involving kinesiology, such as the medical field, athletic training, biomedical engineering, or other such fields, may recognize further configurations that may be suitable for use in the shoulder, as well as in other locations of the body.

It will also be noted that the arrangement of kinesiology strips 180 on wetsuit 100 may be configured to provide benefits for the desired use. For example, kinesiology strips 180 may be arranged on wetsuit 100 to provide advantages to a surfer during paddling and/or while riding waves. Thus, shoulder strips 181 may be disposed in a shoulder portion of wetsuit 100, and may be configured to bias an arm of a wearer of wetsuit 100 in a direction that supports a surfboard paddle stroke.

In some configurations, kinesiology strips 180 may be disposed in an arm region of the wetsuit. For example, as shown in FIG. 22A, wetsuit 100 may include forearm strips 182. Forearm strips may be disposed on an anterior surface of the arm, and may be configured to support anterior flexion of the wrist and the exertion of forearm muscles to keep the hand and wrist locked during a paddle stroke. In addition, as also shown in FIG. 22A, wetsuit 100 may include elbow strips 189. In some configurations, elbow strips may be located on an anterior side of the arm, and thus, may bias the arm toward flexion of the elbow, thereby supporting bicep flexion and the connective tissues associated with it. In other configurations, elbow strips 189 may be disposed on a posterior side of the arm, and thus, may be configured to bias an arm of a wearer of wetsuit 100 toward a straightened elbow position.

As shown in FIG. 22A, in some configurations, wetsuit 100 may include one or more kinesiology strips 180 disposed in an anterior portion of leg region 130 of wetsuit 100 and associated with the knee. For example, wetsuit 100 may include patellar strips 183 and/or horseshoe shaped strips 184. Other configurations of knee strips are also possible. Patellar strips 183 and/or horseshoe shaped strips 184 may be configured to exert tension that supplements the force exerted by musculature that extends the knee of the wearer, such as quadriceps muscles. In addition, patellar strips 183 and/or horseshoe shaped strips 184 may be configured to bias a leg of a wearer of toward a straightened knee position.

It should be noted that biasing a joint may have several benefits. For example, biasing a joint to an extended position may have a hydrodynamic advantage, because a straightened shoulder, elbow, or leg will be more streamlined. In addition, biasing a joint may strengthen the exertion by that joint. For example, biasing knees in either flexion or extension may strengthen the kick of a surfer while paddling.

Figure 22B:
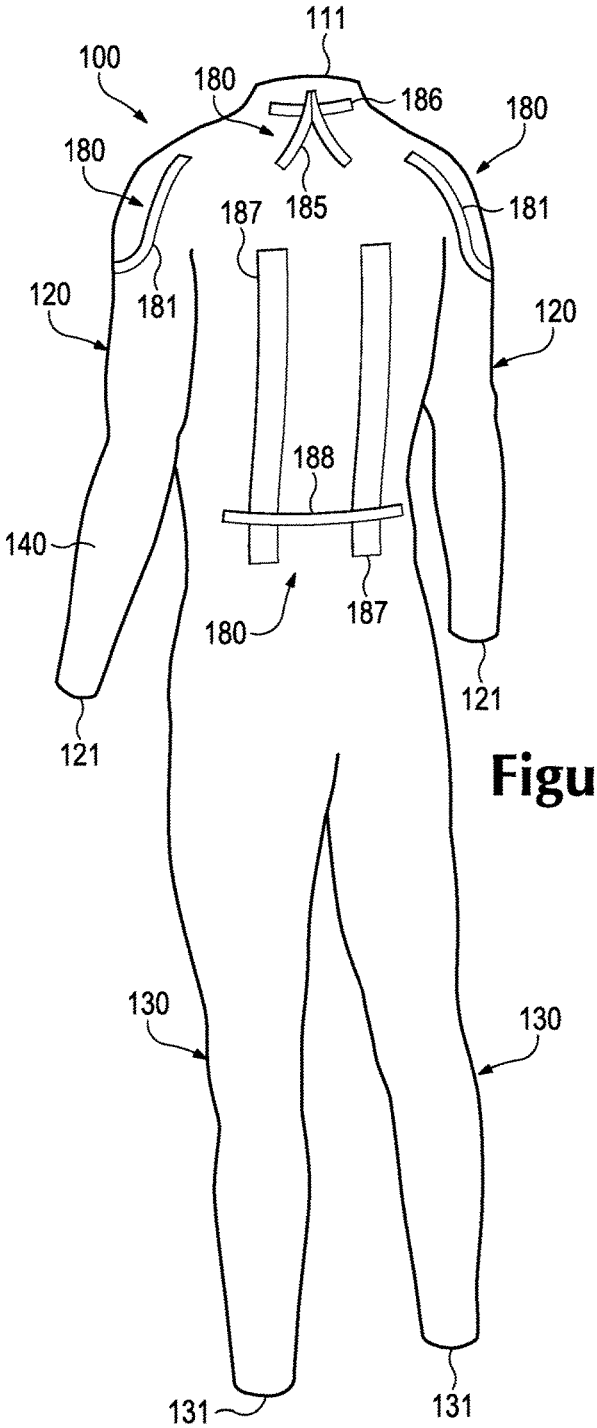
FIG. 22B is a posterior view of the wetsuit shown in FIG. 22A, illustrating a plurality of kinesiology strips disposed on a back portion of the wetsuit.

FIG. 22B is a posterior perspective view of the wetsuit 100 shown in FIG. 22A. Posterior portions of shoulder strips 181 can be seen in FIG. 22B. In addition, wetsuit 100 may include trapezius strips 185 and neck strips 186. Like other strips disclosed herein, the precise configuration of trapezius strips 185 and neck strips 186 may vary.

In some configurations, kinesiology strips 180 may be implemented to provide a tighter fit for select portions of a wetsuit that may have a tendency to fit more loosely than desired for purposes of hydrodynamics and comfort. That is, the tension exerted on wetsuit 100 by the kinesiology strips 180 may provide a closer fit of wetsuit 100 in predetermined portions of the wearer's body. For example, in some configurations, wetsuit 100 may include longitudinal torso strips 187, oriented in a superior-inferior direction, that may tighten the posterior torso region of wetsuit 100. Longitudinal torso strips 187 may also provide support for a surfer's back. While paddling on a surfboard, a surfer lies on their stomach/chest and arches their back upward. Longitudinal torso strips 187 may support this posture and, in some embodiments, may bias the surfer's body toward this posture.

Additionally, or alternatively wetsuit may include a lumbar strip 188 oriented in a lateral direction. Lumbar strip 188 may tighten wetsuit 100 in the lumbar region, which may have a tendency to fit more loosely than desired for optimal hydrodynamics, fit, and comfort.

The description provided above is intended to illustrate some possible combinations of various aspects associated with wetsuit features. Those skilled in the art will understand, however, that within each embodiment, some features may be optional. Moreover, different features discussed in different embodiments could be combined in still other embodiments and would still fall within the scope of the attached claims. Some features could be used independently in some embodiments, while still other features could be combined in various different ways in still other embodiments.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. A wetsuit for aquatic activities, the wetsuit comprising:

a base layer having a first surface and an opposite second surface;

a first backing layer having a first surface and an opposite second surface, the second surface of the first backing layer continuously secured to the first surface of the base layer, the first surface of the first backing layer forming an exterior surface of the wetsuit;

a second backing layer secured to the second surface of the base layer and forming at least a portion of an interior surface of the wetsuit; and at least one sipe linearly extending from the first surface of the first backing layer comprising the exterior surface of the wetsuit through the first backing layer and into the base layer, the at least one sipe extending from an upper portion of a chest region of the wetsuit to a lateral portion of the chest region of the wetsuit.

2. The wetsuit of claim 1, wherein the at least one sipe is curved.

3. The wetsuit of claim 1, wherein a depth of the at least one sipe is approximately 60 percent of the total thickness of the wetsuit between the exterior surface and the interior surface.

4. The wetsuit of claim 1, wherein the at least one sipe is a first sipe and the wetsuit comprises a second sipe, the first sipe being spaced from the second sipe and substantially parallel to the second sipe.

5. The wetsuit of claim 4, wherein the wetsuit comprises:

a first set of sipes including at least the first sipe and the second sipe; and a second set of sipes including at least a third sipe and a fourth sipe spaced from the third sipe and substantially parallel to the third sipe.

6. The wetsuit of claim 5, wherein the first set of sipes extends from the upper portion of the chest region to a right lateral portion of the chest region of the wetsuit, and the second set of sipes extends from the upper portion of the chest region to a left lateral portion of the chest region.

7. The wetsuit of claim 1, wherein the at least one sipe comprises a first end in the upper portion of the chest region and extends from the first end in a generally inferior direction and curves toward a second end in the lateral portion of the chest region.

8. The wetsuit of claim 1, wherein the at least one sipe is formed by a slit cut a predetermined depth into the wetsuit while in a substantially planar arrangement, the slit opening to form a sipe having a substantially v-shaped cross-sectional shape when the wetsuit is worn with the portion of the wetsuit including the slit located over a convex body surface of a wearer.

9. A wetsuit for aquatic activities, the wetsuit comprising:

a base layer having a first surface and an opposite second surface;

a first backing layer having a first surface and an opposite second surface, the second surface of the first backing layer continuously secured to the first surface of the base layer, the first surface of the first backing layer forming an exterior surface of the wetsuit;

a second backing layer secured to the second surface of the base layer and forming at least a portion of an interior surface of the wetsuit; and a plurality of sipes, each of the plurality of sipes linearly extending from the first surface of the first backing layer comprising the exterior surface of the wetsuit through the first backing layer and into the base layer, each sipe of the plurality of sipes having a superior end positioned at an upper portion of a chest region of the wetsuit, an inferior end positioned at a lateral portion of the chest region of the wetsuit, and an intervening portion disposed between the superior end and the inferior end.

10. The wetsuit of claim 9, wherein the intervening portion of the each sipe is curved.

11. The wetsuit of claim 9, wherein the each sipe of the plurality of sipes is spaced apart from an adjacent sipe.

12. The wetsuit of claim 11, wherein adjacent sipes are substantially parallel to each other.

13. The wetsuit of claim 11, wherein adjacent sipes are non-parallel to each other.

14. The wetsuit of claim 11, wherein a first space between a first pair of adjacent sipes is different than a second space between a second pair of adjacent sipes, and wherein the first pair of adjacent sipes is parallel to the second pair of adjacent sipes.

15. A wetsuit for aquatic activities, the wetsuit comprising:

a base layer having a first surface and an opposite second surface;

a first backing layer having a first surface and an opposite second surface, the second surface of the first backing layer continuously secured to the first surface of the base layer, the second surface of the first backing layer forming an exterior surface of the wetsuit;

a second backing layer secured to the second surface of the base layer and forming at least a portion of an interior surface of the wetsuit;

a first set of sipes linearly extending from the first surface of the first backing layer comprising the exterior surface of the wetsuit through the first backing layer and into the base layer, the first set of sipes positioned on a first side of a chest region of the wetsuit; and a second set of sipes linearly extending from the first surface of the first backing layer comprising the exterior surface of the wetsuit through the first backing layer and into the base layer, the second set of sipes positioned on a second side of the chest region of the wetsuit.

16. The wetsuit of claim 15, wherein the first side is a left side of the chest region of the wetsuit, and wherein the second side is a right side of the chest region of the wetsuit.

17. The wetsuit of claim 15, wherein each sipe in the first set of sipes extends from an upper portion of the chest region of the wetsuit to a lateral portion of the chest region.

18. The wetsuit of claim 15, wherein each sipe in the second set of sipes extends from an upper portion of the chest region of the wetsuit to a lateral portion of the chest region.

19. The wetsuit of claim 1, wherein the first backing layer is continuously secured to the first surface of the base layer in the chest region of the wetsuit and forms an exterior surface of the wetsuit in the chest region of the wetsuit.

* * * * *